US008459518B2

(12) United States Patent
Demsky

(10) Patent No.: US 8,459,518 B2
(45) Date of Patent: Jun. 11, 2013

(54) BACKPACKS CONFIGURED TO UTILIZE SAFETY HARNESSES

(76) Inventor: Steven Demsky, Vancouver, WA (US)

( * ) Notice: Subject to any disclaimer, the term of this patent is extended or adjusted under 35 U.S.C. 154(b) by 613 days.

(21) Appl. No.: 12/202,866

(22) Filed: Sep. 2, 2008

(65) Prior Publication Data

US 2009/0057360 A1 Mar. 5, 2009

Related U.S. Application Data

(60) Provisional application No. 60/969,635, filed on Sep. 2, 2007, provisional application No. 60/969,739, filed on Sep. 4, 2007.

(51) Int. Cl.
*A45F 3/04* (2006.01)

(52) U.S. Cl.
USPC ..... 224/576; 224/637; 224/628

(58) Field of Classification Search
USPC ..... 224/637, 628, 630, 631, 633, 635, 224/638, 641, 262, 662, 663, 675, 625, 576; 2/76, 237
See application file for complete search history.

(56) References Cited

U.S. PATENT DOCUMENTS 3,957,184 A * 5/1976 Shurman ..... 224/630
4,307,826 A 12/1981 Stewart
4,318,502 A 3/1982 Lowe et al.
4,982,884 A * 1/1991 Wise ..... 224/634
5,114,059 A * 5/1992 Thatcher ..... 224/148.5
5,136,724 A * 8/1992 Grilliot et al. ..... 2/81
5,184,763 A 2/1993 Blaisdell et al.
5,465,886 A 11/1995 Scherer
5,704,530 A * 1/1998 Scherer ..... 224/632
5,725,139 A * 3/1998 Smith ..... 224/637
5,727,720 A 3/1998 Thatcher
5,732,867 A 3/1998 Perkins et al.
5,806,741 A 9/1998 Kirk
5,823,414 A * 10/1998 Gal et al. ..... 224/637
5,836,489 A 11/1998 Swetish
5,890,640 A 4/1999 Thompson
5,988,315 A * 11/1999 Crane ..... 182/3
6,015,073 A * 1/2000 Wojciak et al. ..... 224/251
6,079,602 A 6/2000 Howell
6,081,930 A * 7/2000 Phillips ..... 2/237
6,276,584 B1 * 8/2001 McLachlan ..... 224/637
6,321,959 B1 11/2001 Howell
6,481,528 B2 * 11/2002 Antonio ..... 182/6
6,536,641 B1 * 3/2003 Sundara et al. ..... 224/637
6,607,107 B2 8/2003 Dexheimer
6,607,108 B2 * 8/2003 Mydans ..... 224/630
6,634,533 B2 10/2003 Thompson et al.

(Continued)

FOREIGN PATENT DOCUMENTS

EP 60796 A1 * 9/1982
EP 638262 A1 * 2/1995

OTHER PUBLICATIONS

Pictorial and written description by Applicant of commercial product: "e-Link" system.

*Primary Examiner* — Justin Larson
(74) *Attorney, Agent, or Firm* — Baumgartner Patent Law; Marc Baumgartner

(57) ABSTRACT

Novel backpacks, configured to utilize seat and/or chest harnesses are disclosed herein. Preferred backpacks are configured to attach to and be supported by intermediary connectors including hip belts or backpack supports that can operably couple to separate seat harnesses.

22 Claims, 13 Drawing Sheets

U.S. PATENT DOCUMENTS

| | | | | |
|---|---|---|---|---|
| 6,658,666 | B2 * | 12/2003 | Schweer | 2/94 |
| 6,971,476 | B2 | 12/2005 | Wolner et al. | |
| 7,000,255 | B1 * | 2/2006 | Baacke | 2/94 |
| 7,028,873 | B1 * | 4/2006 | Collier et al. | 224/628 |
| 2006/0208024 | A1 * | 9/2006 | Gleason, Jr. | 224/633 |
| 2008/0164293 | A1 * | 7/2008 | Foissac et al. | 224/633 |

* cited by examiner

BACKPACKS CONFIGURED TO UTILIZE SAFETY HARNESSES

CROSS-REFERENCE TO RELATED APPLICATIONS

This application claims priority to U.S. Provisional Application Ser. No. 60/969,635, filed Sep. 2, 2007 and U.S. Provisional Application Ser. No. 60/969,739, filed Sep. 4, 2007, both of which are expressly incorporated by reference in their entireties.

FIELD OF THE INVENTION

The embodiments herein relate to backpacks configured to allow users to simultaneously carry a significant load while utilizing one or more safety harnesses. This invention generally relates to any field which is aided by carrying materials via a backpack and can benefit from the added safety of a seat harness and/or a chest harness. Fields that fall into but not limited by this category are: mountaineering, rock climbing, and canyoneering, though this invention may have other uses such as military applications, and search and rescue efforts, for example.

BACKGROUND

Backpacks have evolved considerably and can efficiently and comfortably carry a wide range of weight. The modern backpack may or may not include a rigid frame, the former having the added advantages of the ability to transfer the load to the wearer more efficiently and to carry a substantial load; the latter having the added advantage of the backpack adding a minimum amount of weight to the wearer's overall carried weight. Modern backpack designs transfer weight to the wearer's skeletal frame, specifically to the hipbones and the shoulders, where the shoulders play a secondary role in maintaining maneuverability and balance to the material load carried by the backpack.

Generally a safety harness is an independent item used by a wearer to protect against falling and to provide partial or full support when used with an attached safety line(s). Under certain configurations, safety harnesses also allow the user to conserve energy, as the harnesses can support them against gravitational force during ascents and descents.

In general, there are 3 categories of safety harnesses currently available: 1) a full body harness which distributes a resulting load to the wearer's body including legs, waist, and upper body; 2) a seat harness which applies a resulting load to the wearer's legs and waist; 3) and a chest harness which applies a resulting load to the wearer's chest and shoulders. A seat harness is almost the exclusive form of safety harness for mountaineering, rock climbing, and canyoneering due to the restrictive nature of a full body harness to movement and the chest harness's limitations of safety. Both a seat harness and especially a chest harness have the dangerous potential of the wearer slipping out of the harness when a load is applied to the harness in an adverse direction. Each category of safety harness contains many different models that provide additional features such as fit and added padding for wearer comfort. For example, the construction of most seat harnesses produces a fixed distance between the waist belt and the leg loops which may not fit all wearers. All safety harnesses must be inspected regularly and can become weakened by general wear, excessive abrasion, ultraviolet exposure, an excessive load applied to it as occurs when the harness arrests a fall of the wearer, or a number of other factors. Therefore a safety harness's effective lifespan and ability to not fail if a large load is applied to the safety harness, such as when a fall by the wearer occurs, is dependent on the environment, the frequency of use, past falls arrested by that safety harness, and any other factors that may impact the effectiveness of the safety harness.

Current backpacks exist that are intended to be used with safety harnesses. Typically these backpacks have hip belts configured to be worn on the outside of the seat harness for ease of removing the backpack. These designs usually contain either: 1) a webbing hip belt without padding that is reliant on the padding in the seat harness, 2) a padded hip belt that is shaped to reduce interference when worn with a seat harness, or 3) a standard padded hip belt. Unfortunately, each of the above designs is inherently disadvantageous. For example, a backpack that replaces a padded hip belt for an unpadded webbing hip belt when worn with a seat harness reduces the wearer's comfort when carrying the backpack. A backpack with a padded hip belt, even when shaped to reduce interference, worn with a seat harness can result in painful pressure points where the safety harness is pressed into various sensitive areas of the wearer such as the protruding section of the hipbones. These backpack designs generally incorporate features that can be used with seat harnesses but not with chest harnesses or full body harness.

U.S. Pat. No. 4,318,502 describes an integrated backpack and seat harness system that is intended to provide comfort to the wearer. The backpack is designed to release from the integrated hip belt and seat harness by utilizing a webbing loop permanently attached to the harness that attaches and detaches from the backpack. The connection configuration relies on a flexible webbing link between the hip belt and the backpack frame. This design reduces the effective load transfer to the hip belt and results in a stronger reliance on the user's shoulders for load bearing, as opposed to the user's hips. Likewise the disadvantageous configuration prevents the backpack's weight from remaining close to the wearer's body. Additionally, if the user desires the protection of a seat harness, the user must use the included seat harness to utilize the integrated hip belt and seat harness. This results in no personal choice for fit or additional comfort features of the seat harness for the wearer. Additionally, if the integrated hip belt and seat harness's integrity is damaged by any means, such as an arrested fall, abrasion, or frequency of use, the function of the seat harness in the integrated hip belt/seat harness has failed and the entire integrated hip belt/seat harness will require replacement to reduce risk to the wearer due to safety harness failure.

The use of a backpack and seat harness is also potentially dangerous as the seat harness suspends the user mainly by the legs and waist, while the backpack provides additional mass around the upper body. Wearing a seat harness and backpack while suspended by the seat harness can result in the wearer rotating from an upright position to a position with the wearer's head lower than the seat harness. The resulting position places the wearer in an awkward position that is difficult to maneuver out of, and enhances the likelihood of the wearer slipping out of the seat harness or suffering bodily harm. A common method used to prevent this scenario is for the wearer to use a load bearing chest harness (the remainder of this document will refer to a load bearing chest harness as a "chest harness") in combination with the seat harness. Generally the chest harness is not used to arrest the fall, but maintain the wearer in an upright position after the seat harness has arrested the fall. The chest harness is a separate entity from the backpack; the backpack shoulder straps are not designed to withstand the forces that occur from a fall arrest and will likely fail if used as a chest harness. The wearer must foresee the need of a chest harness before he/she is in an adverse situation, otherwise the entire backpack must be removed to put the chest harness on, placing all items, including essential items such as first-aid kits, in the backpack at risk of falling out of reach such as if necessary items fall off of a cliff. Furthermore, light weight chest harnesses are generally constructed by the wearer out of tubular webbing and when worn next to the body as necessary for proper fit, may become uncomfortable while wearing a pack for extended periods of time due to restricted movement and taut edges pressing into the wearer's back and shoulders.

Accordingly, there is a need in the art for new backpack assemblies that allow a user to releasably attach to and support the backpack with a typical seat harness and can be used with or without a comfortable, functional chest harness. One objective of the teachings herein is to provide backpacks that can be integrated with any available seat harness, and maintain desired backpack qualities when no harness is used (e.g., load transfer directed to the hips, and a padded hip belt) and gives the user the option of replacing or exchanging the seat harness. Further objects herein allow a user to use an "intermediary connector", which includes hip belts and backpack supports, with any available seat harness to attach to and support a loaded backpack. Still further embodiments are directed to backpacks incorporating a removable chest harness.

SUMMARY OF THE INVENTION

The embodiments provided herein include improvements over previous backpack and seat harness arrangements and over previous integrated hip belt/seat harness and backpack arrangements. The teachings herein allow for any seat harness to be integrated with a backpack's hip belt to maintain comfort over separate hip belt and off-the-shelf harness arrangements and to permit the user to wear the best personally suited off-the-shelf seat harness available with respect to fit, comfort, and safety. In preferred embodiments, the integrated seat harness/hip belt arrangement quickly releases from the backpack while being worn yet when connected provides a stiff connection to the backpack, producing a more comfortable and maneuverable backpack by transferring the backpack load to the off-the-shelf seat harness/hip belt effectively and maintaining the backpack load position close to the wearer's back. Furthermore, a removable chest harness can be integrated into the backpack to significantly reduce risk to the user from adversely rotating such that his/her head is below the seat harness as may occur during a fall, ascending, or descending of a rope. The chest harness can be removed to reduce weight at the wearer's discretion. According to additional embodiments, the chest harnesses herein can be constructed into the backpack such that a fall will not impact vital portions of the backpack's construction such as the backpack's ability to carry loads in the internal backpack compartment.

According to further embodiments, the chest harnesses provided herein can be easily put on by the wearer without the wearer removing the backpack and placing vital items at risk of falling out of reach of the wearer such as off of a cliff. The design of the chest harnesses herein also allows a user to comfortably wear the chest harnesses with a backpack.

Preferred embodiments are directed to a backpack assembly having a main storage enclosure and means for releasably attaching to a hip belt, wherein said hip belt includes means for releasably attaching to said main storage enclosure and is constructed from an outer layer of material and an inner layer of material attached together to form an internal hollow channel configured to releasably thread a seat harness through. The channel can be enclosed or partially enclosed (e.g., non-continuous) such that the inner and/or outer layer is made with loops, for example.

More specific embodiments are directed to hip belt assemblies wherein said outer layer and inner layer are constructed of fabric, and/or rigid material. It is preferred that the inner layer is not rigid, however. Further embodiments allow for the outer layer and inner layer of material to be sewn together, to form said channel.

Additional embodiments include the main storage enclosure and said hip belt further comprise means for transferring the weight load from the backpack to the hip belt. Said means can include a rigid support, for example. Advantageously, the rigid support can include a rigid frame member attached to the main storage enclosure and configured to engage with a connective member located on the hip belt. In further embodiments, the frame member can include a connective sheath, and said connective member on the hip belt can be a connective rod configured to fit within said connective sheath. In other preferred embodiments, the connective sheath can include an attached spring configured to releasably apply pressure to a latched connective rod when said connective rod is positioned upward into said connective sheath. Additionally, the frame member can include a connective rod, and said connective member on the hip belt can be a connective sheath configured to receive and support said connective rod. Furthermore, said connective sheath can include an attached spring configured to releasably apply pressure to a latched connective rod when said connective rod is positioned downward into said connective sheath.

Further embodiments are directed to a backpack assembly having a main storage enclosure and means for releasably attaching to a backpack support, wherein said backpack support includes means for releasably attaching to and means for supporting said main storage enclosure and is configured to attach to a seat harness. Preferred means for supporting said main storage enclosure include a connective member configured to operably connect with and support a frame member on the main storage enclosure, for example. Additionally the frame member can include a connective sheath, and said connective member on the backpack support include a connective rod configured to fit within said connective sheath. In additional embodiments, the connective sheath can include an attached spring configured to releasably apply pressure to a latched connective rod when said connective rod is positioned upward into said connective sheath. Additionally, the frame member can include a connective rod and said backpack support can include a connective sheath configured to receive and support said connective rod. Furthermore, said connective sheath can include an attached spring configured to releasably apply pressure to a latched connective rod when said connective member is positioned downward into said connective sheath. Additional means for supporting said main storage enclosure comprises a mount configured to operably connect with and support a mating connecter attached to the main compartment. Preferably, the mount can include a plurality of hinged gates, configured to receive a mating connector attached to said main storage enclosure.

Further embodiments herein are directed to backpack assemblies having an opening configured to allow a user to position a chest harness behind a layer of material positioned to abut against a user's back when worn and a plurality of openings configured to allow said user to access and secure chest harness on their body while wearing said backpack assembly. Preferably said layer of material is a pocket constructed from fabric and configured to receive back padding. Preferably, said opening is located on said pocket and can be configured such that a user can place and remove a chest harness between the pocket and the main storage enclosure of the backpack. According to more specific embodiments, the pocket can be sewn substantially around its perimeter to attach to said main storage enclosure, and is configured, in combination with the chest harness, to suspend the weight of a loaded backpack assembly, and the user secured into said chest harness after a typical fall from a rope, without damaging the backpack assembly.

Further embodiments are directed to backpack assemblies comprising: a main storage enclosure and an intermediary connector configured to operably couple with a separate seat harness and having means for releasably attaching to and supporting the main storage enclosure. The intermediary connecter can be a hip belt or a backpack support. Preferred means for supporting the main storage enclosure can include a rigid frame member attached to the main storage enclosure and configured to engage with a pocket located on the intermediary connector. Preferred assemblies include means for supporting the main storage enclosure and can include a plurality of rigid frame members attached to the main storage enclosure and configured to engage with a plurality of pockets located on the intermediary connector.

Backpack assemblies herein can also comprise a layer of material positioned to abut against a user's back when worn, wherein said layer of material comprises an opening configured to allow a user to insert and remove a chest harness behind said layer of material and further include a plurality of openings configured to allow said user to access and secure the inserted chest harness on their body while wearing said backpack assembly. Preferably, the layer of material is a pocket constructed from fabric and configured to receive back padding. Additionally, the pocket can be sewn substantially around its perimeter to said main storage enclosure, and can be configured to allow an inserted chest harness to suspend the combined weight of a loaded backpack assembly and a user without damaging the backpack assembly.

The intermediary connector can be a backpack support and the means for supporting the main storage enclosure can include a pocket on the backpack support configured to engage with a frame member attached to the main storage enclosure. Other advantageous means for supporting said main storage enclosure can include a mount having a plurality of hinged gates, configured to receive a mating connector.

Further embodiments are directed to backpack assemblies having a main storage enclosure having means for releasably attaching to a hip belt constructed from a bottom panel of pliable material hinged to a top panel of pliable material such that the bottom and top panels can fold together and unfold away from each other to allow for the removable insertion of a separate seat harness between said bottom and top panels. Preferably, the top and bottom panels can include means for releasably attaching to each other when said panels are folded together. Additionally, the top panel can include a plurality of flaps wherein at least one flap comprises a releasable fastener configured to couple with a releasable fastener on said bottom panel when the top and bottom panels are folded together. In other embodiments, at least one of said panels comprises a buckle configured to releasably attach to the other panel when said top and bottom panels are folded together. Preferably, at least one of said bottom and top panels includes padding. The backpack assembly can also include means for transferring the weight load, such as a rigid frame member attached to the main storage enclosure and configured to engage with a pocket located on the hip belt.

Furthermore, the means for transferring the weight load can comprise a plurality of rigid frame members attached to the main storage enclosure and are configured to engage with a plurality of pockets located on the hip belt.

Further backpack assemblies can include a main storage enclosure coupled to a hip belt constructed from an inner panel of pliable material coupled to an outer panel of pliable material such that said outer and inner panel of the hip belt define a space configured to allow for the removable insertion of a separate seat harness. Alternatively, one or more of the panels can include a non-continuous material, such that there are one or more openings in the panel. Hip belts herein can further include means for transferring the weight load of the main storage enclosure to the hip belt, including one or more rigid frame members attached to the main storage enclosure configured to engage with one or more pockets located on the hip belt.

BRIEF DESCRIPTION OF THE DRAWINGS

It will be appreciated that the drawings are not necessarily to scale, with emphasis instead being placed on illustrating the various aspects and features of embodiments of the invention, in which.

DETAILED DESCRIPTION OF THE ILLUSTRATED EMBODIMENTS

Embodiments of the present invention are described below. It is, however, expressly noted that the present invention is not limited to these embodiments, but rather the intention is that modifications that are apparent to the person skilled in the art and equivalents thereof are also included.

Backpacks

Figure 1:
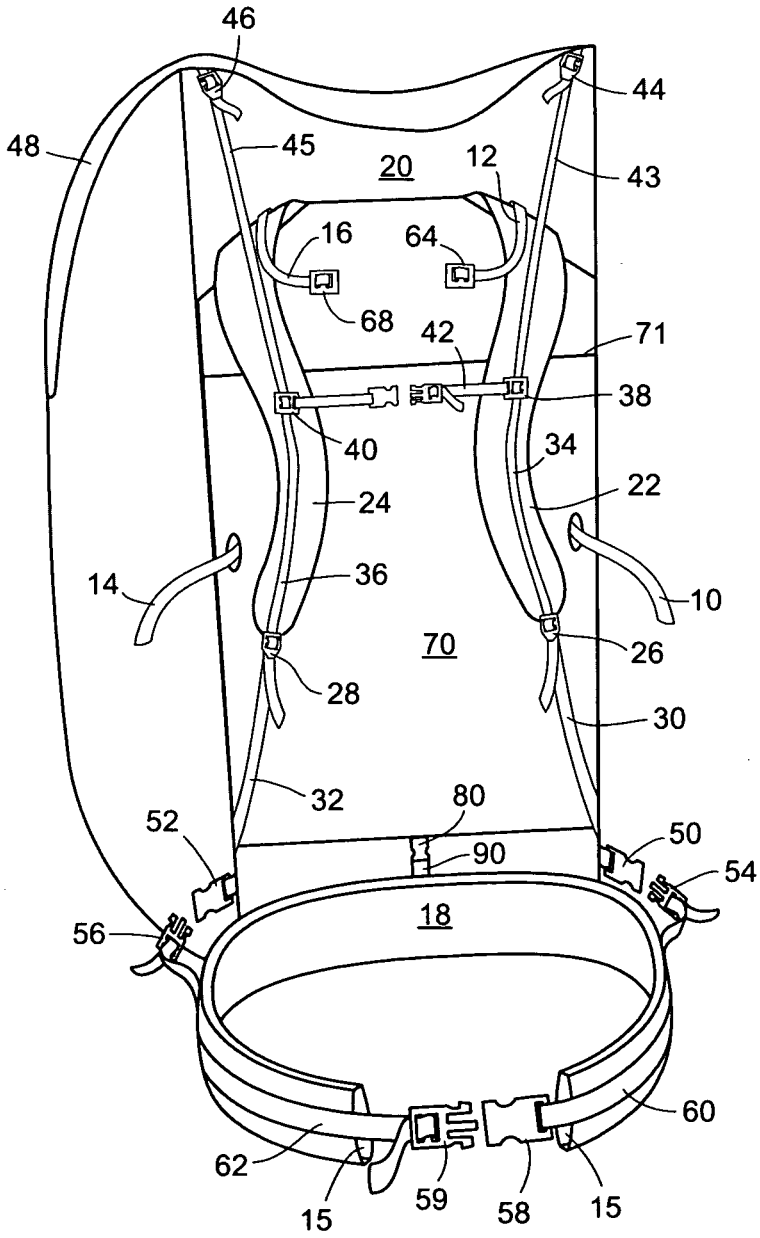
FIG. 1 is a perspective view of a backpack and hip belt.
Figure 5A:
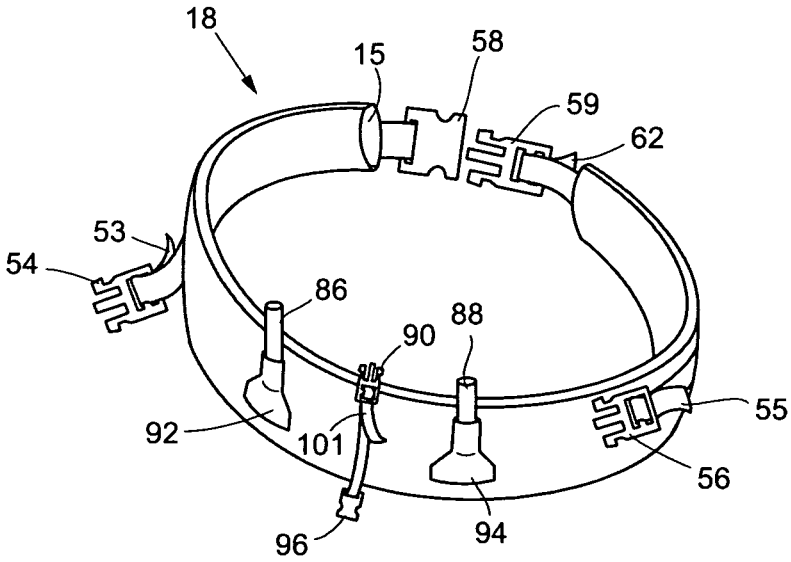
FIG. 5*a* is a perspective view of a hip belt detached from a backpack.
Figure 5B:
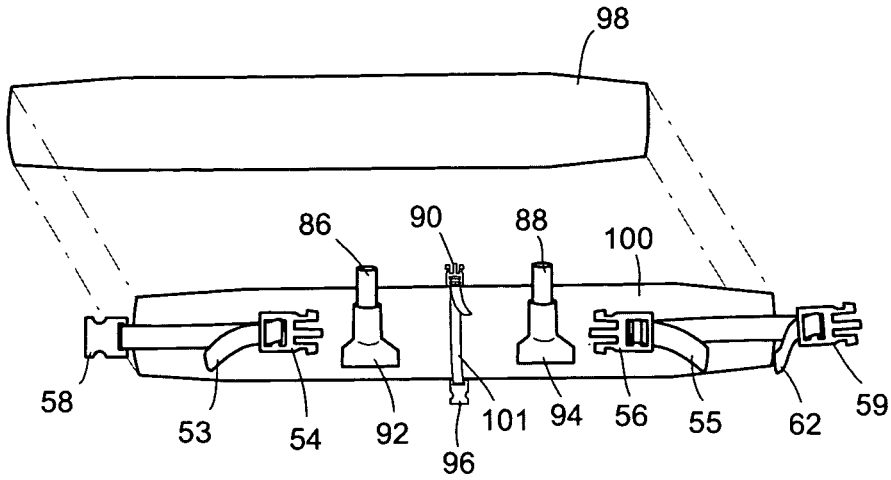
FIG. 5*b* is an exploded view of a hip belt detached from a backpack.
Figure 5C:
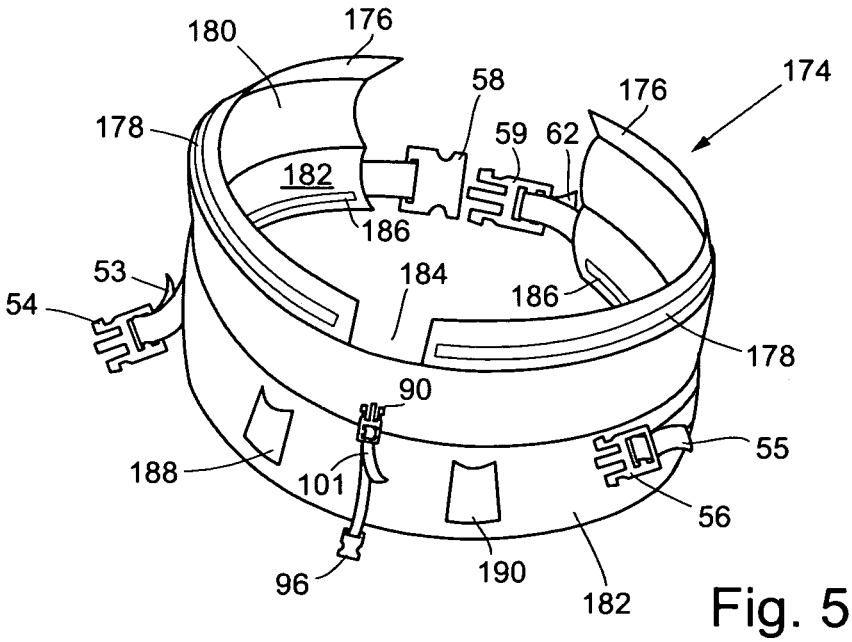
FIG. 5*c* is a perspective back view of a preferred hip belt opened and configured to receive a seat harness.
Figure 5D:
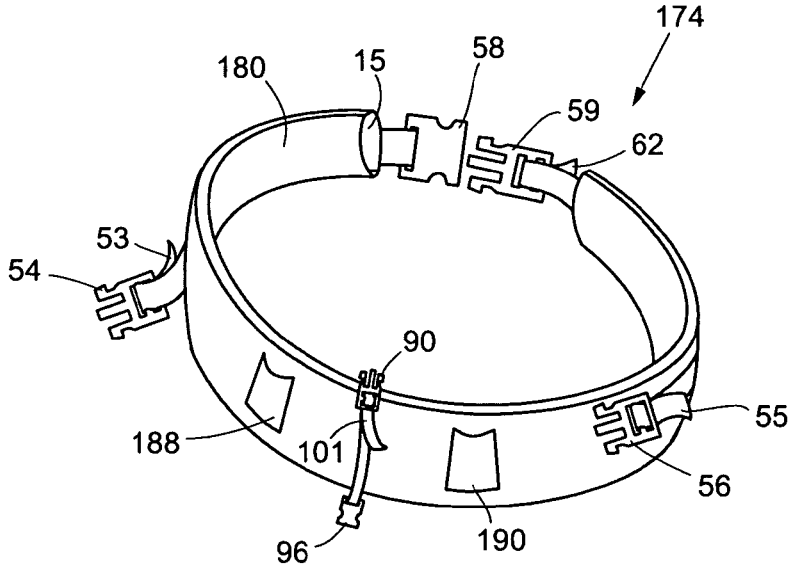
FIG. 5*d* is a perspective back view of a preferred hip belt, closed and without a seat harness.
Figure 5E:
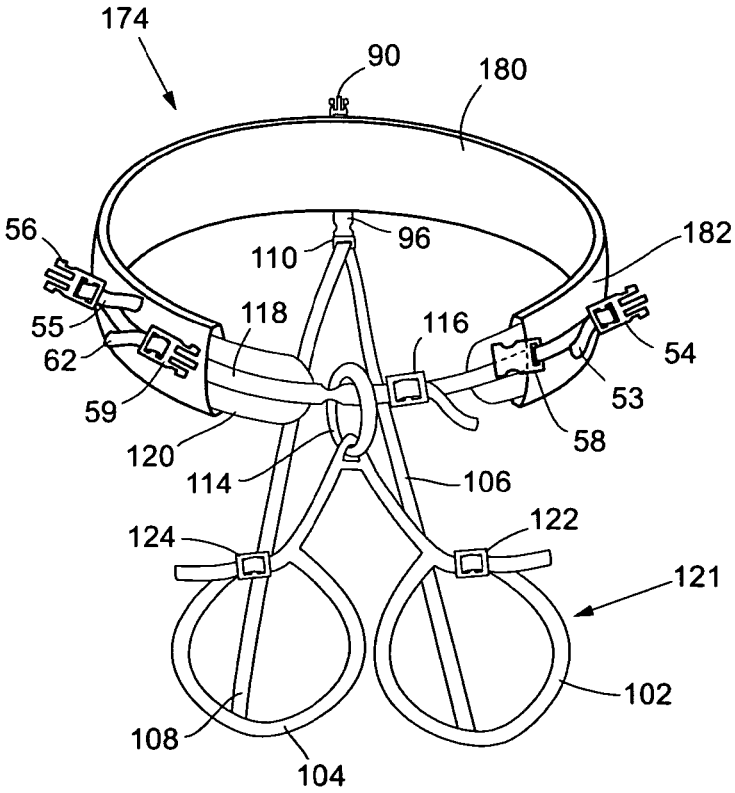
FIG. 5*e* is a perspective front view of a preferred hip belt enclosing a seat harness.

FIG. 1 depicts a perspective view of a preferred backpack 20 and hip belt 18. The backpacks 20 and harnesses provided herein can readily be adapted and/or interchanged to non-exclusively work with either a first hip belt 18 or a preferred folding hip belt 174 (FIGS. 5*c*-5*e*). Accordingly description related to the first hip belt 18 is also intended to apply to the folding hip belt 174, and vice versa. According to advantageous embodiments, the backpacks 20 described herein are preferably pliable with minimal frame structure. While the backpacks 20 provided herein can be constructed using any suitable method, frame structure, and material in the industry, it is preferred that the backpacks described herein be constructed primarily from nylon fabric. Other preferred materials of the backpacks described herein can non-exclusively include HYPALON®, CORDURA®, GORTEX®, closed cell foam or other padding, polyester fabric, and plastic.

Preferred backpacks will have first and second shoulder straps, also referred to as "shoulder pads", 22 and 24. Typically, shoulder straps 22 and 24 are tightened and loosened by adjusting the length of their respective webbing 30 and 32, through their respective buckles 26 and 28. According to this embodiment, it is preferred that the webbings 30 and 32 are constructed from nylon webbing, but can be made of any pliable and strong material. In further embodiments, it is preferred that buckles 26 and 28 are plastic ladder lock buckles, but can be any suitable buckle that allows the user to securely adjust the length of webbings 30 and 32. Buckles 26 and 28 can be securely attached to their respective shoulder straps 22 and 24 by any suitable method, including stitching, for example.

In further embodiments, the shoulder straps 22 and 24 can be reinforced with webbing 34 and 36, respectively. The shoulder straps 22 and 24 and/or the webbing 34 and 36 can also include removable or non-removable gear loops for attaching hiking or climbing equipment, such as spring-loaded camming devices, passive rock climbing protection devices, chalk bags, carabineers, and the like, for example. These gear loops can either be load bearing or non-load bearing depending on the needs of the user. In other embodiments the shoulder straps 22 and 24 are not reinforced with webbing. According to preferred embodiments, the webbings 34 and 36 can nonexclusively be constructed from nylon webbing, or other suitable, strong, and pliable material.

It is additionally advantageous to have the backpacks provided herein include stabilizer straps 43 and 45 attached to their respective shoulder straps 22 and 24 or webbings 34 and webbing 36. According to advantageous embodiments, the stabilizer straps 43 and 45 are constructed from nylon webbing, or from other suitable, pliable, and strong material. The length of stabilizer straps 43 and 45 are preferably adjustable by buckles 44 and 46. In further embodiments, it is preferred that buckles 44 and 46 are plastic ladder lock buckles, but can be any suitable buckle that allows the user to securely adjust the length of the stabilizer straps 43 and 45. Buckles 44 and 46 can be securely attached to the backpack 20 by any suitable method, including stitching, for example.

In additional embodiments, the shoulder straps 22 and 24 are kept in a more comfortable position by a sternum strap 42. With respect to this embodiment, the sternum strap 42 is preferably constructed from nylon webbing and configured to quickly release, through the use of a buckle, or other suitable quick release means. In alternative embodiments, the sternum strap 42 can be constructed from any suitable, strong, and pliable material. In more specific embodiments, the sternum strap 42 can be secured to webbings 34 and 36 by plastic three-way connectors 38 and 40, respectively, but any suitable method to connect the sternum strap 42 to webbings 34 and 36 can be used.

In further preferred embodiments the backpack includes a flap 48 configured to conceal and secure the contents within the backpack 20. The flap 48 can be attached to the backpack 20 by any suitable method commonly known in the industry. In preferred embodiments, the flap 48 is hinged to the top of the backpack 20, to allow the user to easily expose and conceal the backpack's 20 contents. According to preferred embodiments, the flap 48 is constructed of water resistant coated nylon, ordinary nylon fabric, HYPALON®, CORDURA®, and/or GORTEX®, or any other suitable material. In other embodiments, the backpack 20 can utilize a drawstring closure to conceal the contents within the backpack.

Figure 2:
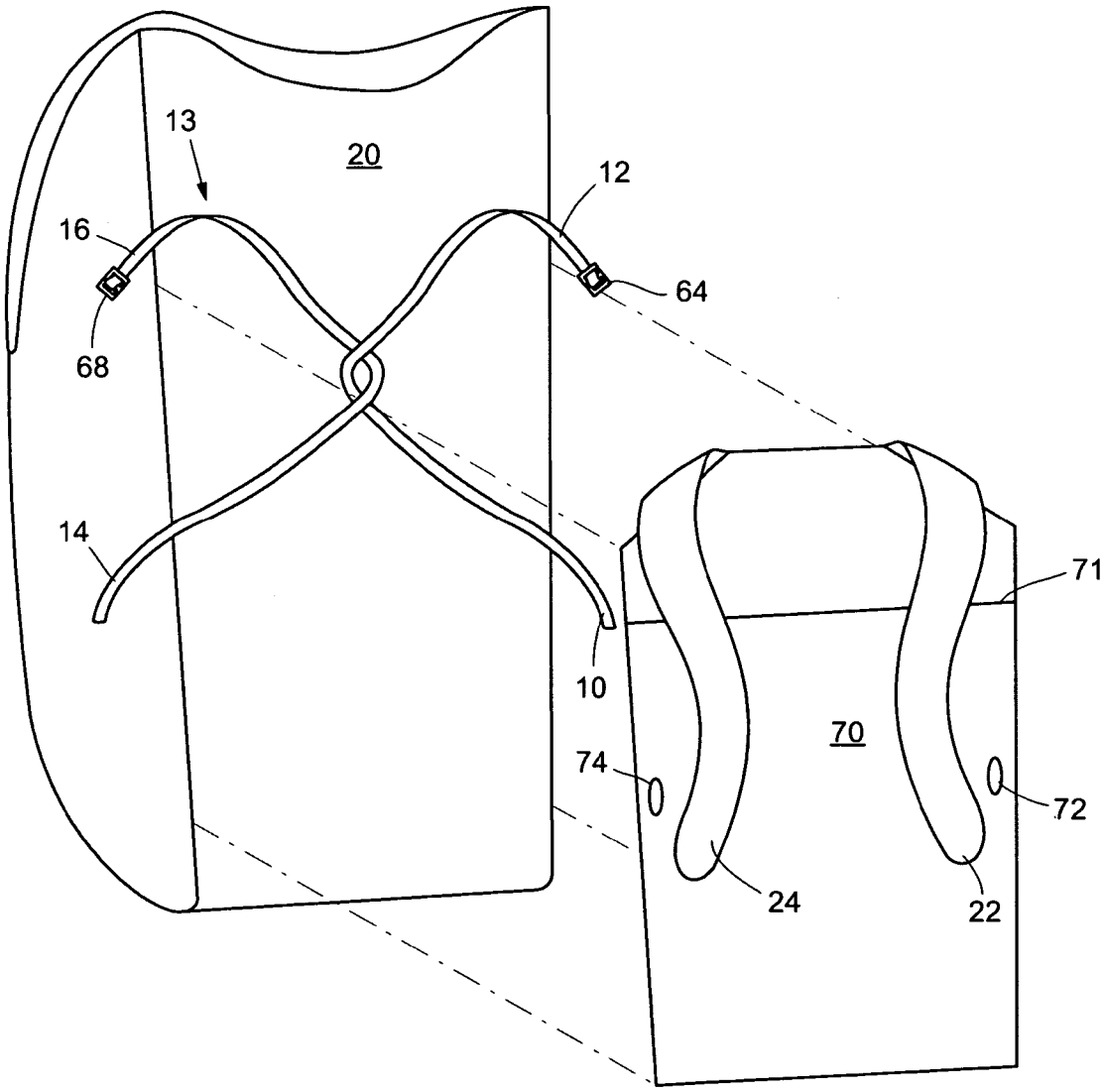
FIG. 2 is an exploded view of a backpack showing an integrated chest harness behind the pocket.
Figure 3:
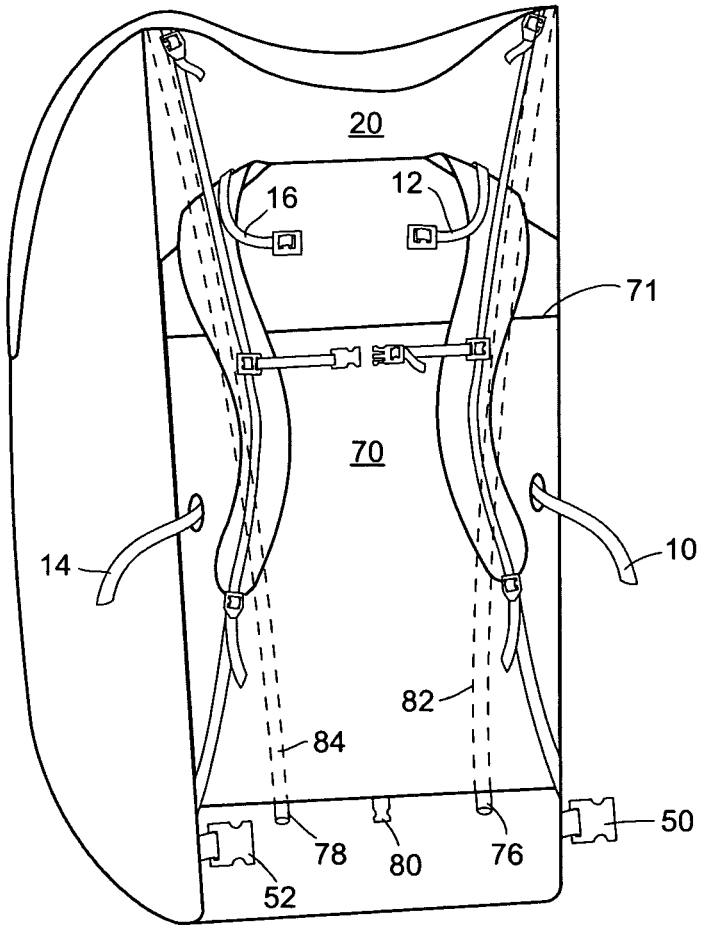
FIG. 3 is a perspective view of a backpack detached from the hip belt.

According to preferred embodiments the backpacks 20 provided herein can include a pocket 70. FIG. 2 depicts an exploded view of a preferred backpack 20, where the pocket 70 has been removed from backpack 20 to expose the internal chest harness 13. In certain embodiments, the pocket 70 includes a front layer of fabric configured to abut against the user's back when worn and stitched to a back layer of fabric configured to be positioned against the backpack 20. In other embodiments, the pocket is a single layer of fabric. In more specific embodiments, the pocket 70 can include an upper portion and a bottom portion, separated by a slit 71 that traverses across the pocket 70 laterally. In certain embodiments, the slit 71 cuts through both the front and back layers of fabric that make up the pocket 70. This preferred configuration, allow a user to place a chest harness 13 through the slit 71 in order to position a chest harness 13 between the back layer of the pocket 70, and the backpack 20. The slit 71, likewise allows a user to remove the chest harness 13 from behind the pocket 70. This embodiment is especially advantageous should the user desire to replace a worn chest harness, or simply needed a different size or comfort level.

In even more specific embodiments, the inside of the pocket 70 is preferably hollow to allow a user to stuff padding inside. Preferred padding includes closed cell foam. As the padding is pliable, the user can bend the top of the padding and push it through the slit 71 in order to position it within the pocket 70. Once inside the pocket 70, the padding can be straightened from its bent configuration to fill the top portion of the pocket 70, above the slit 71.

In even more preferred embodiments, the pocket 70 is stitched substantially around its perimeter to the backpack 20. In more specific embodiments, there are small, unstitched openings in the top of the pocket 70, near the shoulder straps 24 and 22 (or in another suitable location) to allow the ends 68 and 64 of the chest harness 13 to pass through. FIG. 1, where chest straps 12 and 16 are exposed, depicts a preferred location for the top openings on the pocket 70. The top openings are preferably between 1 and 2 inches in length, and more preferably about 1.5 or 1.2 inches in length, but can be any suitable distance. Additionally, it is preferred that the pocket 70 includes two openings 74 and 72 in the lower portion, configured to allow the pulling segments 14 and 10 of the chest harness 13 to pass through.

One main goal of the teachings herein is to provide backpacks 20 configured to detach from a supporting hip belt 18 and 174 that is integrated with a removable seat harness 121. According to non-preferred methods, 1 or more (e.g., 2, 3, or 4) internal frames 84 and 82 can be located within the main compartment of the backpack 20, but are preferably positioned externally to the main compartment, more specifically between the pocket 70 and the main compartment. Those with skill in the art will readily appreciate other locations for the 1 or more internal frames. The internal frames 84 and 82 are preferably made of a rigid, strong material, such as carbon fiber, plastic, or metal (e.g., aluminum, titanium, etc), for example. Preferred rigid internal frames can be tubing with polygonal, rectangular, circular or other cross-sectional shape, a sheet, or any other configuration that will support the backpack 20. According to more preferred methods, the internal frames 82 and 84 are made of fiberglass cylindrical tubing. According to further embodiments, the internal frames 82 and 84 can be held in place within the backpack 20 by two sewn enclosures vertically traversing along the length of the frames 82 and 84, or by other suitable means. The sewn enclosures are preferably made using nylon material, including nylon webbing; however any suitable material can be used, including plastic, for example.

According to further embodiments, the ends of the internal frames 82 and 84 can be attached to connective sheaths 76 and 78 that are exposed at the bottom of the backpack 20, and configured to mate with connective rods 86 and 88 located on the hip belt 18. In more specific embodiments, the connective sheaths 76 and 78 can be constructed from aluminum cylindrical tubing, or other suitable material including steel alloy, for example, and can be attached to the ends of the internal frames 82 and 84 by epoxy. Other suitable means for attaching the connective sheaths 76 and 78 to the internal frames 82 and 84 can be used, including further adhesives. In more specific embodiments, the connective sheaths 76 and 78 can protrude underneath the pocket of the backpack 20 through reinforced holes in the fabric, by approximately an inch.

Figure 4A:
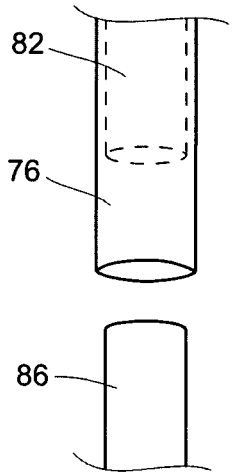
FIG. 4*a* is a close-up view of an unengaged coupling mechanism between a hip belt and the backpack.
Figure 4B:
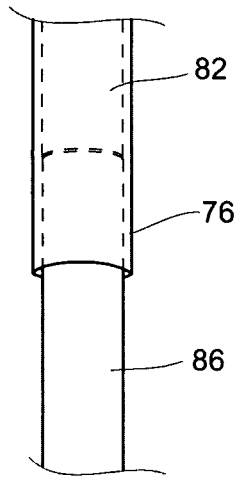
FIG. 4*b* is a close-up view of an engaged coupling mechanism between hip belt and the backpack.

FIGS. 4*a* and 4*b* depict a connective sheath 76 mating with its respective connective rod 86. While only depicting one internal frame 82, connective sheath 76, and connective rod 86, the configurations provided in FIGS. 4*a* and 4*b* are also applicable to a second internal frame 84, connective sheath 78, and connective rod 88. The connective rods 86 and 88 can be cylindrical in shape, having a smaller outside diameter than the inside diameter of their respective connective sheath 76 and 78. Other geometrical shapes of complementary sheaths and rods are also contemplated herein, including square, polygonal, and rectangular, for example. It is also expressly contemplated that the locations of the sheaths and connective rods can be switched such that the connective rods are located on the internal frames, and the connective sheaths or pockets are attached to the hip belt, as shown in FIGS. 5*c* and 5*d*. According to more specific embodiments, the internal frames 82 and 84 can act as rods without sheaths and can be configured to slide into one or more complementary sheaths, or pockets 188 and 190, on the hip belt. Preferred pockets can be made from any suitable pliable or non-pliable material, including fabric and plastic for example. In other embodiments, the internal frame can be a sheet configured to slide into a wider sheath or pocket.

It is preferred that when a connective sheath 76 or 78 mates with its respective connective rod 86 and 88, the rod abuts against its respective internal frame, as shown in FIG. 4*b*. In other embodiments, the connective rod 86 or 88 does not abut against its respective internal frame 82 and 84. In other preferred embodiments, the connective sheaths 76 and 78 do not have to be entirely hollow, and can have a raised internal shoulder or a solid center for the internal frames 82 and 84 and the connective rods 86 and 88 to abut against.

In further embodiments, the backpacks provided herein can also include a buckle member 80 configured to attach to a complementary buckle member 90 that is attached to outer layer of a hip belt 18 and 174 as shown in FIGS. 5*a*-5*e*. This buckle member 80 is advantageous as it can help the backpack from separating from the hip belt and/or dislodging the connective rods 86 and 88 from their respective connective sheaths 76 and 78 or internal frames 82 and 84 from their pockets 188 and 190. Any suitable quick release couplers can be used to maintain the connective rods 86 and 88 inside their respective connective sheaths 76 and 78 or internal frames 82 and 84 within their pockets 188 and 190.

Chest Harnesses

According to advantageous embodiments, the backpacks provided herein can include a chest harness 13 configured to attach to a safety rope and having sufficient load bearing strength to prevent the user from hanging in an upside down position after a fall. According to more specific embodiments, the chest harnesses 13 described herein can include two intertwined chest straps 12 and 16, as shown in FIG. 2. More specifically, it is preferred that each chest strap 12 and 16 has a buckle (64 and 68 respectively) located at one end of the strap, and a pulling segment (10 and 14 respectively) at the opposite end of the strap. According to preferred embodiments, it is preferred that the chest straps 12 and 16 are constructed of tubular nylon webbing; however any suitable, pliable, and strong material can be used. According to preferred embodiments, the chest harness buckles 64 and 68 are load bearing aluminum buckles; however other suitable load bearing buckles can be used.

In preferred embodiments, a first chest strap 12 traverses between a shoulder pad 22 and backpack 20, and under the pocket 70 that holds the back padding. Likewise, a second chest strap 16 traverses between a shoulder pad 24 and backpack 20, and under the pocket 70 that holds the back padding, such that it intertwines one ore more times (e.g., 2, 3, 4, 5, 6, and 7) with the first chest strap 12 behind the pocket 70. Alternatively, the first chest strap 12 and/or second chest strap 16 can pass through a hole in shoulder strap 22 and/or shoulder straps 24, or a hole in backpack 20 or pocket 70 (Not shown). According to preferred embodiments, the chest straps 12 and 16 can be either permanently or releasably attached by known means to the shoulder straps 22 and 24, the backpack 20, or the pocket 70, or any other reasonable place to attach chest strap 12 and/or chest strap 16.

According to preferred embodiments, the shoulder pads 22 and 24, are sewn to the backpack 20 and the pocket 70 configured to hold the back padding, is sewn to the backpack 20 afterwards.

According to preferred embodiments, the chest straps 12 and 16 are permanently sewn to buckles 64 and 68 respectively. Additionally, other methods of load-bearing permanent and temporary attachment can be used. In addition to having the buckles 64 and 68 strongly attached to the chest straps, it is also highly advantageous for the pulling segments 14 and 10 to be releasably, yet strongly attached to a one or more buckles 68 or 64 when the chest harness 13 is secured to the user. Each of the pulling segments 10 and 14 can be securely attached to either buckle 68 or 64, such that the configuration can sufficiently prevent a user from hanging upside down after a fall. To obtain a more secured fit, the user can thread the pulling segments 14 or 10 back through their respective buckles 68 or 64 a second time; a configuration typically referred to as a "double back".

In other embodiments, it is preferred that the chest strap buckles 68 and 64 are exposed near the top of the backpack 20, such that a user can readily thread the pulling segments 14 and 10 of the chest straps through their respective buckles (68 and 64). According to more specific embodiments, the pulling segments 14 and 10 are exposed through holes 74 and 72, respectively. The holes 74 and 72 are preferably located at a convenient location on the pocket 70, nonexclusively including below the user's armpit, such that when the chest harness 13 is worn, it provides a secure and snug fit and the pulling segments 14 and 10 hang below the holes 74 and 72 and are readily accessible by the user's hands. The perimeters of the holes 74 and 72 can be reinforced with either plastic or additional layers of fabric to prevent the straps 12 and 16 from tearing the material of the pocket 70 or the back padding. While shown in the figures as having the buckles 68 and 64 at the top of the chest straps, this orientation is expressly nonlimiting and can readily be reversed, such that the buckles 68 and 64 are at the bottom of the chest harness 13 and pass through the lower openings 74 and 72 on the pocket 70.

According to other alternative embodiments, the chest strap buckles 68 and 64 can readily be substituted with other suitable means for securing and adjusting the chest straps 12 and 16. Preferred means can include looping each end of the chest straps 12 and 16 and pulling segments 10 and 14 and connecting them by a load bearing carabineer. Alternative preferred means can include using other rigid or pliable connectors, such as a load bearing knot, for example.

Yet another embodiment includes attaching the chest harness 13 with the shoulder straps 22 and 24. According to this embodiment, the sternum strap 42 can be made of any load bearing strap material such as tubular nylon and the quick release buckle on sternum strap 42 is able to remain connected under high loads. An example of a suitable buckle on the sternum strap would be a metal parachute quick release harness buckle. Furthermore, in this embodiment, the shoulder strap buckles 26 and 28 are either not present or are capable of withstanding high loads. One nonexclusive example of a buckle suitable for these conditions is a metal load bearing buckle.

According to further embodiments, it is desirable that the backpack 20, pocket 70, and holes 74 and 72 are configured such that a user can readily replace said chest straps 12 and 16 and the back padding. This configuration is highly advantageous; especially if the user is concerned that the straps 12 and 16 have excessive wear on them, or if it is desirable to accommodate different sized users. Other advantages include allowing the user to replace or wash the back padding inside the pocket 70 or to use the back padding as a seat cushion and/or insulation from the ground.

Figure 9:
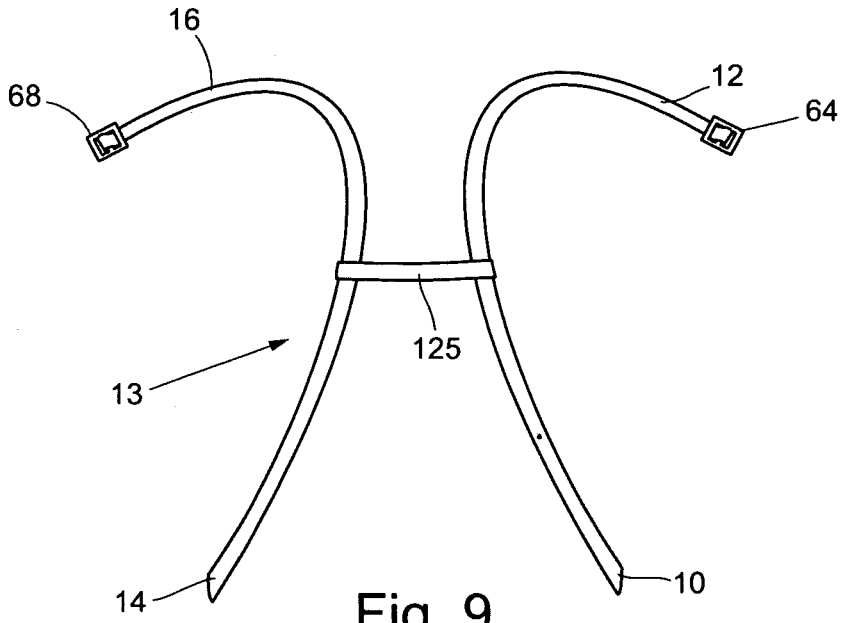
FIG. 9 is a perspective view of an alternative chest harness that can be integrated with the backpacks described herein.

While the chest straps 12 and 16 are depicted in FIG. 2 as intertwining, this is expressly a non-limiting embodiment. More specifically, the chest straps 12 and 16 can be directly attached to each other, through any suitable method including double stitching, hot gluing, such that they maintain sufficient load bearing strength to prevent a user from hanging upside down after a fall. Alternatively, and as shown in FIG. 9, the chest straps 12 and 16 can be connected together by one or more (e.g., 2, 3, 4, 5, or 6) rigid or pliable cross pieces 125. The one or more cross pieces 125 can be made of any suitable strong material (e.g., tubular nylon) and can be connected to the straps 12 and 16 by any suitable method including double stitching, hot gluing, such that the straps 12 and 16 maintain sufficient load bearing strength to prevent a user from hanging upside down after a fall.

In another embodiment, the chest harness 13 can include webbing or rope loops attached to pulling segments 10 and 14 to form a device commonly known as a gear sling. When pulling segments 10 and 14 are secured to buckles 64 and 68, the loops can hang between the user's chest and holes 72 and 74. Additional safety gear commonly used for climbing such as spring-loaded camming devices, passive rock climbing protection, and/or carabineers can be attached to these loops for easy accessibility.

Figure 8:
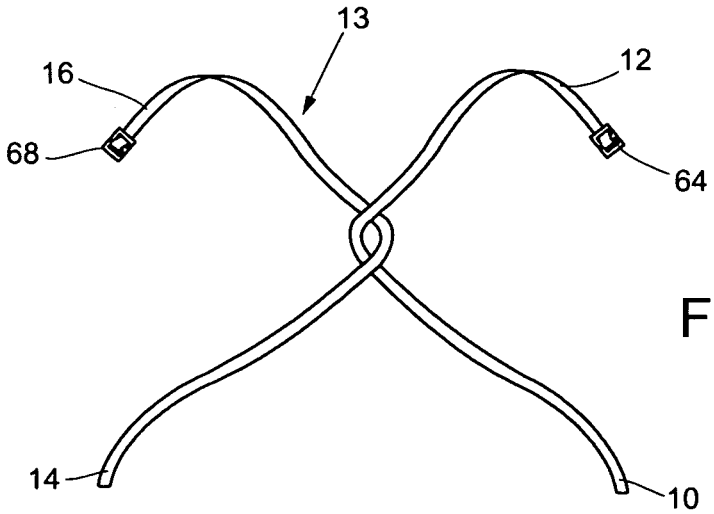
FIG. 8 is a perspective view of a chest harness that can be integrated with the backpacks described herein.

The chest harnesses 13 depicted in FIGS. 8 and 9 can readily be integrated with the backpacks 20 described above and as depicted in FIG. 2. The above description on how the wearer applies, fastens, and uses the chest harness 13 is likewise applicable to the chest harnesses 13 depicted in FIGS. 8 and 9.

According to preferred embodiments, the pulling segments 10 and 14 are fed over the wearer's chest and threaded through buckles 68 and 64 respectively. In more general embodiments, the user can utilize any suitable method to ensure that the pulling segments 10 and 14 do not slip through the buckles and support the necessary load, including tying the pulling segments 10 and 14 to the buckles 68 and 64, or utilizing a "double back" strap feeding technique. According to another preferred configuration, the pulling segment 10 can be fed over the wearer's left arm and threaded through buckle 64 and chest strap 14 can be fed over the wearer's right arm and threaded through buckle 68.

In advantageous embodiments, both chest straps 12 and 16 can be fed through a carabineer attached to a rope properly secured to the wearer's seat harness 121. Preferably the carabineer includes a locking gate to ensure the gate will not open unexpectedly. Alternatively, the carabineer that locks the chest straps 12 and 16 can be attached to a webbing loop capable of withstanding a strong load and that is connected with a carabineer, preferably with a locking gate, to a rope properly secured to the seat harness 121.

Hip Belts

The teachings herein are also directed to hip belts 18 and 174 that are configured to removably integrate with a typical seat harness 121 and attach to and support a backpack 20. Preferred hip belts configured to integrate with a typical seat harness 121 and support a backpack are depicted in FIGS. 1, 5*a*, 5*b*, 5*c*, 5*d*, 5*e* (integrated with a seat harness 121) and in FIG. 7 (integrated with a seat harness 121).

Figure 6A:
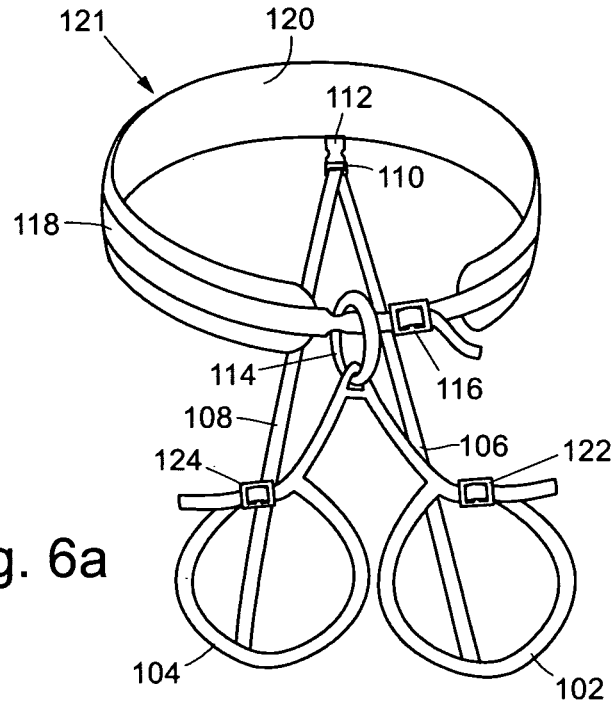
FIG. 6*a* is a perspective view of a common seat harness that can be used with the novel intermediary connectors described herein.
Figure 6B:
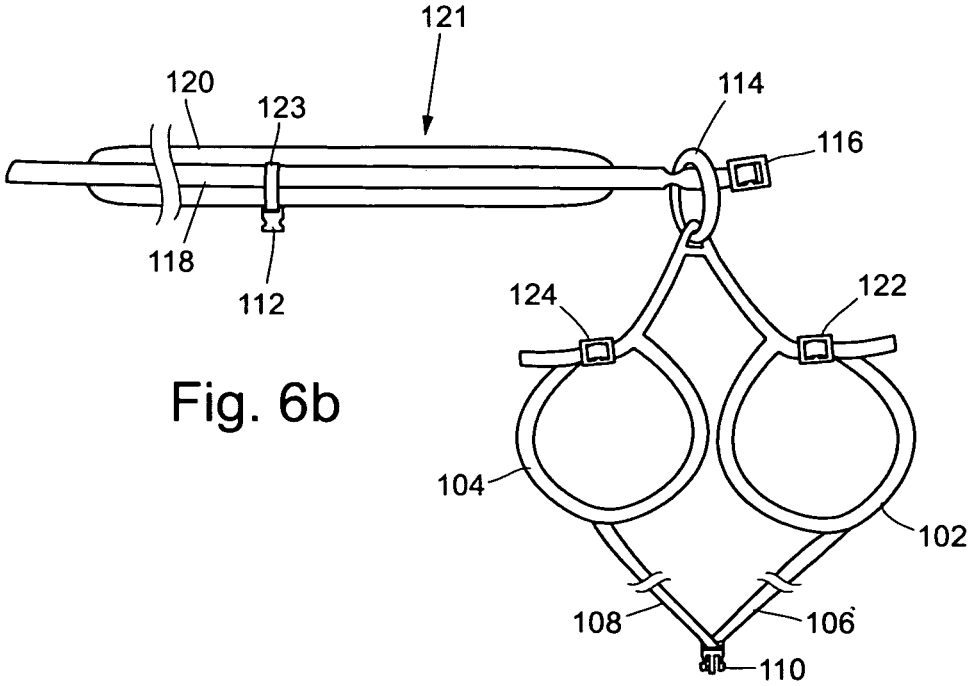
FIG. 6*b* is a side perspective view of a common seat harness that can be used with the novel intermediary connectors described herein.
Figure 7:
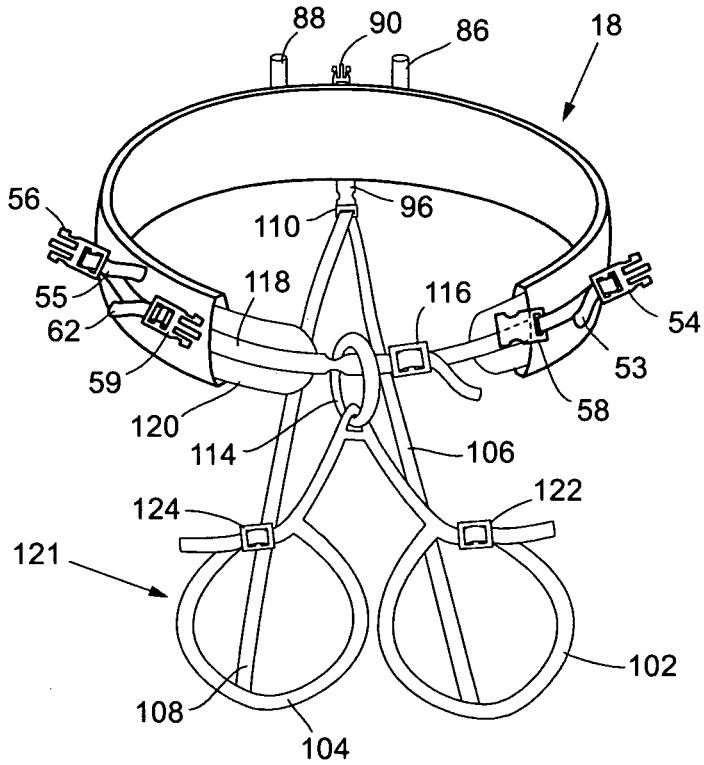
FIG. 7 is a perspective view of a common seat harness integrated with a hip belt.

Hip belts 18 provided herein can include an outer layer 100 and an inner layer 98. The terms "layer" and "panel" can be used interchangeably herein and can signify one layer or two layers of material. Layers and panels herein can be made of continuous and non-continuous material. More specifically, continuous material signifies that the layer or panel does not have a significant opening or hole, while non-continuous material signifies that the layer or panel includes 1 or more openings or holes, and can be ventilated or include mesh for example. Both the outer and inner layer 100 and 98 can be made of 1 or more sheets of nylon fabric, for example. Preferred hip belts 18 and 174 include pliable material such as fabric, foam, reinforced foam, pliable plastic, or other suitable material. In certain embodiments, the outer layer and/or the inner layer individually include two sheets of nylon fabric sandwiching a dense layer of closed cell foam, or other padding. In other embodiments the inner layer 98 is attached (e.g., sewn) to the outer layer 100 to form a hollow channel 15 inside the hip belt 18. More specifically, the inner and outer layer 98 and 100 can be generally rectangular in shape, slightly tapered at the ends, and substantially the same size, such that when sewn together along their longer sides, their shorter sides remain open. Other shapes of hip belts are expressly contemplated herein, including anatomically shaped hip belts that form to the user's hips, for example. The two openings along the shorter sides of the hip belt 18 allow the user to readily insert and remove the seat harness 121, when desired. To integrate the seat harness 121 with the hip belt 18, the user can thread one end of the seat harness 121 through the hollow channel 15 until it is exposed at the opposite end of the hip belt 18. To remove the seat harness 121 from the hip belt, the user, after unbuckling the applicable buckles, can pull the appropriate end of the seat harness 121. For ease of use, the webbing 118 and padding 120 of the seat harness 121 can be threaded through the hip belt, while the leg loops 102 and 104 and belay loop 114 remain outside the channel 15. In more specific embodiments, and with reference to FIG. 6*b*, the seat harness 121 end opposite of buckle 116 is threaded though the channel 15 to integrate with the hip belt, as shown in FIG. 7. Likewise, a user can pull on the buckle 116 to remove the seat harness 121 from the hip belt 18.

FIGS. 5*c*, 5*d*, and 5*e* depict a preferred folding hip belt 174 to be used with the teachings herein. Preferably, the folding hip belt 174 includes a top panel 180 hinged or otherwise coupled to a bottom panel 182 along one of its sides and to one or more flaps (2, 3, 4, etc) 176 on an opposite side. In other embodiments, flaps 176 can be hinged to the bottom of bottom panel 182 and configured to releasably attach to the top panel 180. Both the top panel 180 and the bottom panel 182 have internal and external sides. Preferably, the top panel 180 and/or bottom panel 182 individually include two sheets of nylon fabric sandwiching a dense layer of closed cell foam, or other padding.

The internal sides of these panels 180 and 182 fold in towards each other to close the hip belt 174 and while the external side of the top panel 180 faces the user's body when worn, while the external side of the bottom panel 182 faces away from the user's body when worn.

Preferably the top panel's 180 bottom side is hinged to the top of the bottom panel 182, while the top side of the top panel 180 is hinged to one or more (e.g., 2, 3, 4) downward folding flaps 176 separated by a space 184 configured to allow the buckle 110 attached to the leg loops supports 106 and 108 on the seat harness 121 to pass through and connect to complimentary buckle 112 of seat harness 121. Said one or more flaps 176 preferably include means for releasably fastening to the internal side of the bottom panel 182. For example, as shown in FIG. 5*c*, the two flaps 176 include VELCRO® strips 178 or other hook and loop fasteners configured to releasably fasten to complementary fasteners 186 positioned on the inside of the bottom panel 182. Any suitable releasable fastener besides hook and loop fasteners can be used, non-exclusively including buttons, snaps, zippers, laces, and buckles for example. When the top panel 180 and bottom panel 182 are in an open position (as depicted in FIG. 5*c*) they define a cavity configured to hold a seat harness 121. Preferably a user can place the seat harness 121 into the opened hip belt 174 between the inside of the top panel 180 and the undersides of the flaps 176. With the seat harness 121 positioned between the inside of top panel 180 and the undersides of the flaps 176, the top panel 180 can then be folded downwards towards the bottom panel 182, such that the fasteners 178 on the flaps 176 securely fasten to the complementary fasteners 186 on the internal side of the bottom panel 182 and releasably secure the seat harness 121 within the hip belt 174.

When the seat harness 121 is secured with the hip belt 174, it is preferred that the flaps 176 are positioned between the seat harness 121 and the bottom panel 182 (outer panel) instead of between the seat harness 121 and the top panel 180 (inner panel). This prevents the flaps 176 from increasing the circumference that the seat harness 121 wraps around. In contrast, if the flaps 176 were positioned disadvantageously between the secured seat harness 121 and the inner panel (top panel 180), a user may need to obtain a longer seat harness 176 to accommodate the increased circumference the flaps 176 would be adding. Preferably, the folding hip belt 174 is configured to allow a user to easily and quickly insert and remove a seat harness 121. In other embodiments, the hip belt 174 does not contain flaps 176. In this embodiment the top panel 180 and bottom panel 182 may or may not releasably attach from each other. Means for releasably attaching to each other may include but are not limited to VELCRO®, other hook and loop fasteners, and buckles, where buckles may be located on one or both panels.

Additional embodiments are directed to hip belts having two panels that can completely detach and attach to each other to allow for the insertion and removal of the seat harness 121. With respect to this embodiments, the hip belt 18 or 174 can be configured to be completely removable from the backpack 20 or according to more specific embodiments, the backpack 20 can be configured to be non-releasably attached to the outer layer 100 of the hip belt 18 or the bottom panel 182 in hip belt 174 while the inner layer 98 or the top panel 180 can be configured to completely detach from the outer layer 100 and the bottom panel 182, respectively. This particular embodiment allows the user to remove the backpack 20 while still wearing the seat harness 121 and maintain the inner layer 98 or the top panel 180 secured between the seat harness 121 and the user which allows easier attachment of the outer layer 100 or the bottom panel 182 at a later time. To facilitate these embodiments, one or more panels or layers can include a releasable fastener such as VELCRO® or other hook and loop fasteners, button, zippers, snaps, buckles, and the like to allow for complete separation from each other.

It is preferred that the hip belts 18 and 174 provided herein include complementary buckle members 58 and 59 that allow the user to readily close and open the hip belts 18 and 174 when putting it on and removing it. Buckle member 59 allows the length of webbing 62 to be adjusted to accommodate the waist size of various users. Other embodiments include complementary buckle members 58 and 59 where the length of webbing 62 is adjusted with a ladder lock buckle attached to hip belts 18 and 174 near the attachment of webbing 62 to hip belts 18 and 174, and in further embodiments, the location of buckle member 58 is adjusted with a ladder lock buckle attached to hip belts 18 and 174 in a similar fashion. According to advantageous embodiments, it is preferred that the webbings 60 and 62 are sewn to the outer layer 100 or external side of the hip belt 18 and 174 and constructed from nylon, but can be made of any pliable and strong material. In other embodiments, the hip belt can include a buckle member 96 configured to releasably attach to a complementary buckle member 110 of the seat harness 121 for support of the leg loops 102 and 104.

According to more specific embodiments, the hip belts 18 and 174 includes buckle members 54 and 56 that are respectively complementary to buckle members 50 and 52 located on the backpack 20. Additional buckle members (e.g., 1, 2, 3, or 4) can also be attached to the hip belt 18 and 174, such as buckle member 90 that is complementary to buckle member 80 on the backpack 20. Additional buckle members, such as buckle member 90 are preferably attached to the hip belt by webbing 101. Together these buckle members form a quick release mechanism to easily detach the backpack 20 from the hip belt 18 and 174. Buckle members 54, 56, and 90 are preferably attached to the hip belt 18 and 174 by nylon webbing 53, 55, and 101, respectively, or by other suitable means. The webbing on the hip belt can preferably be adjusted, through the buckles members 54 and 56 to tighten the fit between the hip belt and the backpack, and through buckle member 59 to tighten the fit around the user's waist, such that the weight is centered on the user's hips.

As discussed above, the hip belts herein 18 and 174 can include connective rods 86 and 88 that are configured to mate with the connective sheaths 76 and 78 attached to the internal frames 82 and 84 in the backpack 20. In further advantageous embodiments, the connective rods 86 and 88 can be encased by pockets 92 and 94, respectively. The pockets can be attached to the outer layer 100 or external side of the hip belt 18 and 174 by any method known in the industry, including being sewn. In more specific embodiments, the connective rods 86 and 88 are preferably wide, or flare out, at their bottom ends to limit movement within the pockets 92 and 94, respectively. Additional suitable means of securing the bottoms of the connective rods within their respective pockets can also be used by themselves or in conjunction with widening the bases, including adding an adhesive, for example.

As discussed above in detail, this configuration can readily be reversed such that the internal frames 82 and 84 act as connective rods and are configured to fit within pockets 188 and 190 positioned on the hip belt. Additionally the hip belt can contain 1, 2, 3, 4, or more connective rods, sheaths, or pockets and the backpack can contain the equivalent number of complementary sheaths, rods, or pockets. In other embodiments, the internal frame can have connecting segments, including a sheet that is configured to fit within a wider pocket on the hip belt.

When a user desires to remove the backpack 20 from their body in order to access the contents, they can disconnect the quick release members 54, 56, and 90 from complementary quick release members 50, 52, and 80 respectively. The user can then shrug their shoulders and provide any additional force with their arms to pull the sheaths 76 and 78 off of their respective rods 86 and 88, or frame members 82 and 84 out of their respective pockets 188 and 190. The user can then remove the backpack 20 by slipping the shoulder pads 22 and 24 off of the wearer's shoulders while still wearing the integrated hip belt 18 and 174 and seat harness 121 and remain safe in the seat harness 121, properly secured to a safety line.

In highly advantageous embodiments, the hip belts 18 and 174 provided herein are capable of working with any off-the-shelf seat harness 121. Non-exclusive examples of seat harness 121 that can be used with the teachings herein include those depicted in FIGS. 5*e*, 6*a*, 6*b*, 7, and 11*b*, for example. In general, a seat harness 121 can include two leg loops 102 and 104, adjustable by their respective buckles 122 and 124. The leg loops 102 and 104 are attached to each other and typically pass through a belay loop 114. Additionally, the seat harness 121 typically includes webbing 118 that passes through a belay loop 114. In general, the webbing 118 can be adjusted with a buckle 116 for fitting with the load bearing, double back method and is padded by padding 120. The leg loops 102 and 104 are usually held up for comfort by leg loop supports 106 and 108, respectively. The leg loop supports 106 and 108 typically attach to the webbing 118 by a quick-release buckle having complementary members 110 and 112. The first complementary quick release buckle member 112 is usually attached to the webbing 118 by a haul loop 123. The haul loop 123 is a reinforced loop able to haul additional weight or haul line/rope behind the user when they are moving up vertical terrain, and is preferably attached around the webbing 118 of the seat harness 121. FIG. 6*b* depicts an opened off-the-shelf general seat harness 121 with a haul loop.

The wearer can wear backpack 20 and hip belt 18 as shown in FIG. 1. According to certain embodiments, the backpack may or may not contain an integrated chest harness 13. In further embodiments the user can configure the chest straps of the chest harness 13 such that they are out of the way, by tying them off, for example.

Figure 10A:
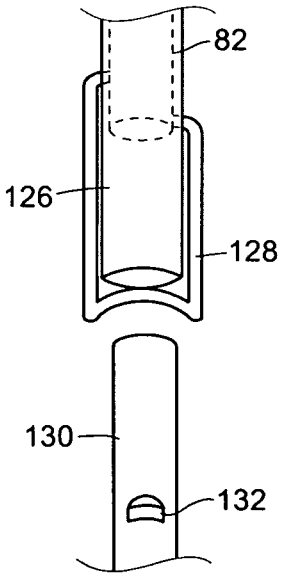
FIG. 10*a* is a close-up view of an alternative unengaged coupling mechanism between a hip belt and the backpack.
Figure 10B:
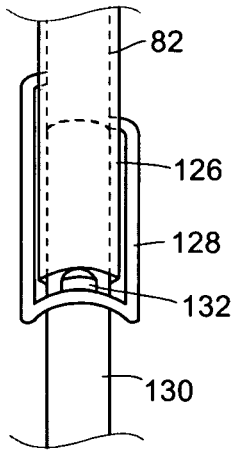
FIG. 10*b* is a close-up view of an alternative engaged coupling mechanism between a hip belt and the backpack.
Figure 10C:
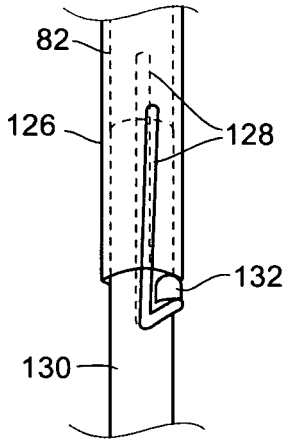
FIG. 10*c* is a close-up view of an alternative engaged coupling mechanism between a hip belt and the backpack.

FIGS. 10*a*, 10*b*, and 10*c* depict an alternative coupling method between hip belt 18 and 174 and backpack 20. According to this embodiment, the connection of backpack 20 to hip belt 18 and 174, is obtained through the use of one or more (e.g., 2, 3, 4) latched rods 130 connected to the hip belts 18 and 174 and configured to mate with one or more (e.g., 2, 3, 4) sheaths 126 utilizing a spring 128. According to this embodiment, it is preferred that two rods 130, each having a latch 132, are configured to mate with two sheaths 126 having springs 128 and are attached to two internal frames 82 and 84. In preferred embodiments, the number of sheaths 126 corresponds to the number of internal frames 82 and 84 within the backpack 20. As will be described below, because the spring 128 and latch 132 assemblies prevents the rods 130 from being displaced from the sheaths 126, these embodiments can be used with or without the complementary buckle members 80 and 90. The position of all means described herein for connecting the hip belts to the backpacks, including means for supporting the backpacks, can readily be reversed. For example, the position of the latched rods and sheaths can be switched such that the lateral rods are positioned on the backpack and the sheaths or pockets are positioned on the hip belts.

In preferred embodiments, the spring 128 is constructed such that it applies force to the latched rod 130 when mated with the sheath 126. More specifically, it is preferred that when the sheath 126 and rod 130 are pushed together, the spring 128 slides over the front ramp of latch 132. After the sheath 126 and latched rod 130 are fully mated as shown in FIGS. 10*b* and 10*c*, the spring 128 pushes against the rod 130 and the flat or undercut back-side of latch 132 thereby prevents the sheath 126 and latched rod 130 from separating. Similar to the first embodiment of non-latched rods 86 and 88, described above, the latched rods 130 can abut against the internal frames 82 or 84, or be configured in the other variations described above. Additionally this configuration can be reversed such that the latched rods 130 can be located on the backpack, connected to the internal frames 82 and 84, and the sheaths 126 having springs 128 can be positioned on the hip belt.

To remove the latched rods 130 from the sheaths 126, the wearer can preferably first release complementary buckle members 56 and 52 in addition to 54 and 50. In embodiments, where two springs 128 are used, it is preferred that they face inward toward each other. More specifically, the springs can be attached together by a rigid or pliable connector, (e.g., nylon webbing) and configured such that an upward force applied to the connector would open both springs 128 at least by a distance sufficient to allow both springs 128 to slide over their respective latches 132. (Not shown).

At the same time the latches are released, the wearer can shrug their shoulders and apply any extra needed force with their hands to allow both latched rods 130 to separate from their respective sheaths 126. Upon release, the backpack 20 can then be removed from wearer while the wearer can remain in his/her hip belt 18 and 174/seat harness 121 that may or may not be secured to a safety line.

To put the backpack on again, the user can slide both arms through the appropriate shoulder pad 22 and shoulder pad 24 and connect complementary buckle members 56 to 52 and 54 to 50. The wearer can then shrug their shoulders such that the 1 or more latched rods 130 slide into their respective 1 or more sheaths 126. When the wearer stops shrugging their shoulders, the springs 128 can slide over the ramped part of both latches 132, thereby locking the rods 130 into their sheaths 126 and thereby securing backpack 20 to hip belt 18 and 174.

Backpack Supports

In addition to being able to attach to the hip belts 18 and 174 provided herein, in alternative embodiments backpacks 20 can also be configured to couple with backpack supports 170 and 172. The term "intermediary connector" as used herein encompasses both hip belts 18 and 174 and backpack supports 170 and 172. In contrast to hip belts 18 and 174, backpack supports 170 and 172 are not configured to wrap around a user's waist. Backpack supports 170 and 172 are smaller than hip belts 18 and 174 and are preferably configured to only attach to a portion of a seat harness 121. As FIGS. 11*a*-11*b*, 12*a*-12*b*, and 12*g* depict, preferred backpack supports 170 and 172 are configured to vertically wrap around the belt of the seat harness 121.

Figure 11A:
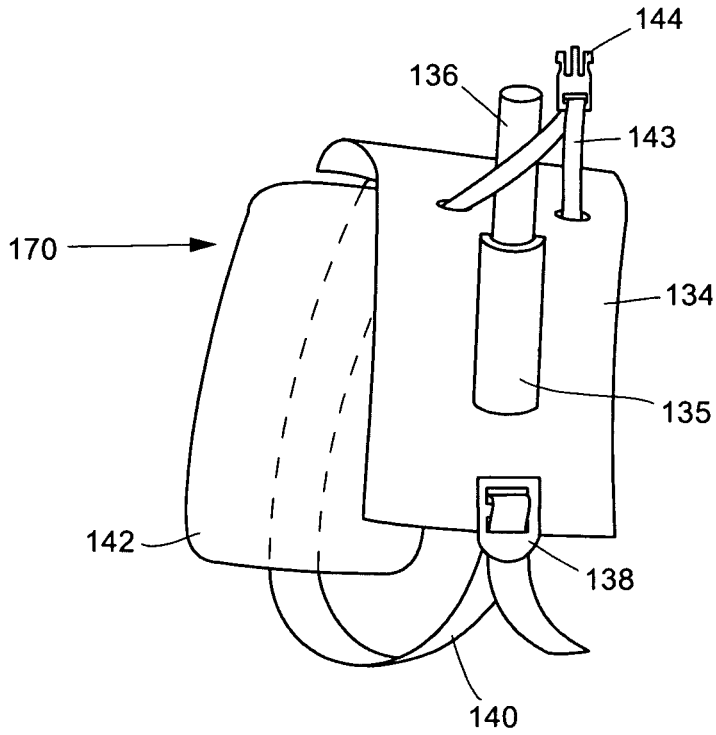
FIG. 11*a* is a perspective view of a backpack support that allows a common seat harness to attach to and support a backpack, without the use of a hip belt.

FIG. 11*a* depicts an alternative embodiment for attaching a typical seat harness 121 to a backpack 20. In this embodiment, the wearer does not use the hip belts 18 and 174 described above, but instead uses a standard off-the-shelf seat harness 121 integrated with one or more (e.g., 2, 3, or 4) backpack supports 170 to attach to and support the backpack 20. In preferred embodiments, the backpack supports 170 can be used with the seat harnesses 121 described herein, including any available seat harness 121.

According to advantageous embodiments, the backpack support 170 includes a support element 134 having a curved top to fit over the seat harness padding 120, and can be made of any suitable rigid or semi-rigid material, including rigid plastic, aluminum, steel, or titanium, for example. Preferably, the backpack support 170 includes adjustable webbing 140 threaded through a buckle 138 to allow the user to tighten and loosen the support element 134 around the seat harness padding 120. According, to advantageous embodiments, the webbing 140 connects the support element 134 to the padding 142. Additional features can be added to the backpack support 170 to prevent lateral movement along the padding of the seat harness 121 by utilizing hook and loop fasteners such as VELCRO®, snaps, or other fasteners. For example, fasteners can be attached to the internal side of the support element 134 and/or padding 142 that are configured to couple with complementary fasteners on harness padding 120.

The webbing 140 is preferably made of nylon webbing, though any pliable strong material can be used. In more specific embodiments, it is preferred that the backpack support 170 includes padding 142 (e.g., closed cell foam padding, or other padding) configured to be internally located on the seat harness 121, to add comfort to the user. In other embodiments, the backpack support 170 does not include padding.

In further embodiments, the backpack support 170 can include a connective member 136 molded into a support base 135 on the support structure 134. In more specific embodiments, the support base 135 can be a continuous piece integrated with the support structure 134. Other suitable means for attaching the connective member 136 to the support structure 134 can be used, including welding, for example. In other embodiments, connective member 136, support structure 134, and support base 135 are one continuous piece of the chosen material.

In certain embodiments, the connective member 136 mates with a connective sheath 76 or 78 attached to an internal frame 82 or 84. In more preferred embodiments the backpack support includes one or more pockets that are configured to engage with one or more internal frame members, such that the one or pockets can support a loaded backpack (not shown). If only a single pocket is used, it is preferred that it is configured to engage with a medially positioned frame member, or substantially so. If only one backpack support 170 is attached to the seat harness 121 it is preferred that the connective member 136 have sufficient load bearing strength to support a loaded backpack. The strength of the connective member 136 can be enhanced by increasing its diameter, reinforcing the support base 135 with additional materials, or using strong metals, for example.

In other preferred embodiments, two backpack supports 170 can be attached to a seat harness 121, in order to provide additional support to the backpack 20. According to this embodiment, the two connective members 136 would individually mate with the connective sheaths 76 and 78 on the backpack 20 thereby creating two points of support, instead of one. Additionally, 3, 4, or 5 backpack supports could be used respectively with 3, 4, or 5 connective sheaths 76 and 78 on the backpack 20. Alternatively, the backpack supports can include a connective sheath or pocket configured to mate with an internal frame or connective rod located on the backpack. (Not shown)

In other embodiments, the backpack support can include a quick release member 144 complementary to a second quick release member 80 on the backpack 20. The quick release member 144 can be attached to the backpack support by any suitable means, including webbing 143 (e.g., nylon), stitching, fasteners, gluing, or welding. When webbing 143 is used, it is preferably secured by rivets. The quick release member 144 is useful in keeping the backpack 20 in close connection with the backpack support 170, such that the connective member 136 does not dislodge from its sheath 76 and 78. Alternatively, the internal frames 82 and 84 do not dislodge from the pockets on the preferred embodiment of the backpack support 170. Additional quick release members (e.g., 2, 3, and 4) can be present on the backpack support 170 that are complementary to quick release members on the backpack, according to additional embodiments. (Not shown)

The connective members 136 on the backpack support 170 can attach to the backpack 20 in all the ways described above with respect to the connective rods 86 and 88, the connective sheaths 76 and 78, and with the latched rods 130 and spring sheaths 126. Furthermore, 1 or more connective members 136 can be used on a seat harness 121 (e.g., 2, 3, 4, 5), depending on a variety of factors, non-exclusively including the weight of the backpack 20, and the number of internal frames 82 and 84 and connective sheaths 126, 76, and 78 attached to the backpack 20.

Figure 11B:
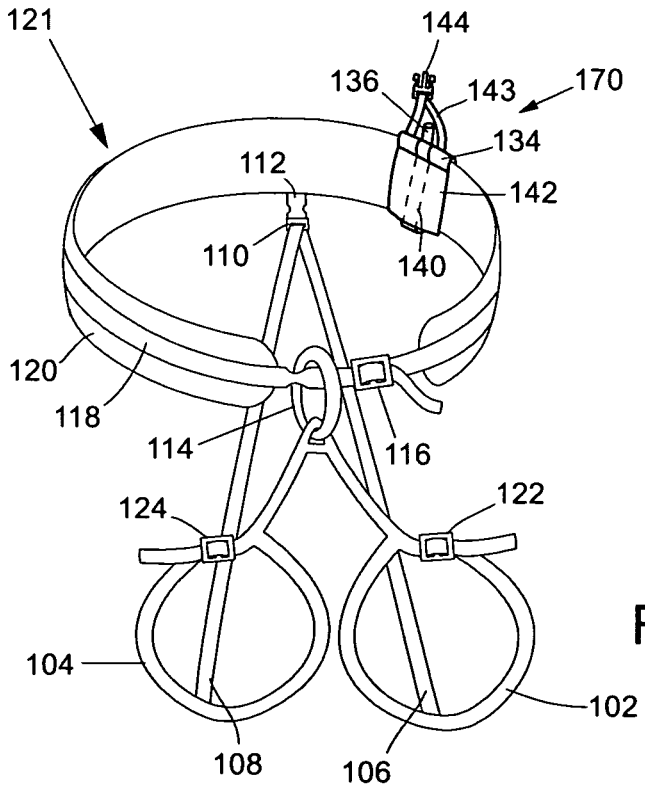
FIG. 11*b* is a perspective view of a backpack support integrated with a common seat harness and detached from a backpack.

According to preferred embodiments, a user can attach two backpack supports 170 on the seat harness 121 before wearing the seat harness 121. FIG. 11*b* depicts the placement of one preferred backpack support on the seat harness 121 for clarity. The placement of the backpack support 170 found in FIG. 11*a*, is preferably adjacent to said frame members 82 and 84 and/or exposed sheaths 76, 78, or 126.

According to preferred methods of attaching the backpack 20 to said backpack support 170, the user can advantageously position the padding 142 to align with the seat harness padding 120 for additional comfort. The user can preferably tighten webbing 140 that is threaded through buckle 138. Upon donning the seat harness 121 integrated with the backpack support 170 by the appropriate method, the user can position the backpack 20 to attach to said backpack support 170. Preferably, the user slides their appropriate arms through their respective shoulder pads 22 and 24 and shrugs their shoulders in order to slide the connective member 136 into its respective connective sheath 76, 78, or 126 or frame members 82 or 84 into a pocket found on backpack support 170.

FIG. 12*a*-12*g* depict an alternative backpack support 172 configured to attach to an off-the-shelf seat harness 121 and rapidly attach to and detach from a backpack 20. This embodiment is similar to the backpack support 170 depicted in FIG. 11, and described in detail above. All features of the backpack support 170 not relating to connection to the backpack 20 are applicable to these embodiments. In this embodiment, the support structure 134 can be a rigid plastic, or other suitable rigid or semi-rigid material. The support structure 134 preferably has a curved upper section to hook over the top of seat harness 121 and padding 120. The webbing 140 can be secured to the top of the support structure 134 and is configured to secure support structure 134 around the seat harness 121 and padding 120. Preferred webbing 140 is made of nylon webbing, or other suitable strong and pliable material. The padding 142 is preferably attached to the webbing 140 and can be made of any suitable cushioned material, including encased closed celled foam, for example. Padding 142 is not necessary to the function of this device and need not be used for all embodiments. Preferably, the backpack support 172 includes adjustable webbing 140 threaded through a buckle 138 to allow the user to tighten and loosen the support element 134 around the seat harness padding 120.

Additional features can be added to the backpack support 172 to prevent lateral movement along the padding of the seat harness 121 by utilizing hook and loop fasteners such as VELCRO®, snaps, or other fasteners. For example, fasteners can be attached to the internal side of the support element 134 and/or padding 142 that are configured to couple with complementary fasteners on harness padding 120.

In highly preferred embodiments, the backpack support 172 includes a mount 148 that is molded into the support structure 134 and forms an opening, preferably a half-cylinder opening, configured for receiving a mating connector 162 attached to the frame members 82 or 84 of backpack 20. Preferred mating connectors 162 non-exclusively include frame members, 82 and 84, for example. The inside diameter of the opening (e.g., half-cylinder opening) in the mount 148 is preferably slightly larger than the outside diameter of the mating connector 162 attached to the backpack 20. In further embodiments, a support 146 can be molded into the base of the mount 148. Advantageously, the support 146 helps prevent the mating connector 162 from slipping downward when a load is applied.

Figure 12A:
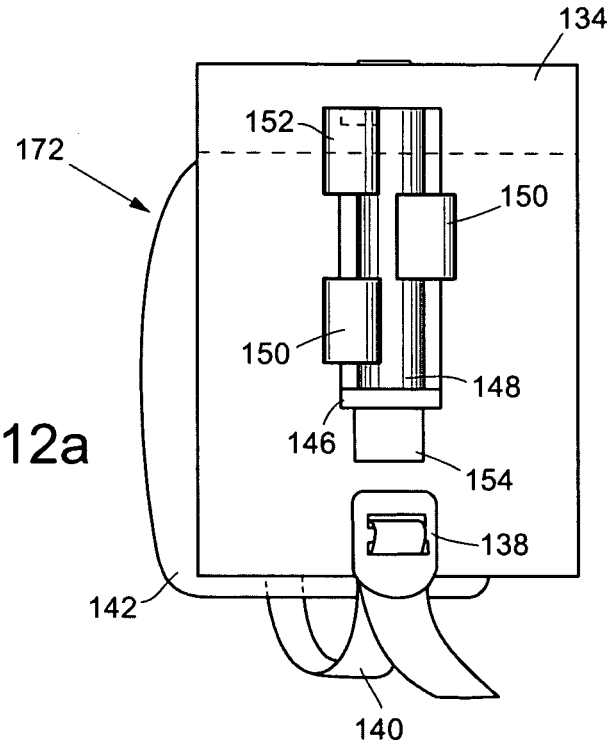
FIG. 12*a* is a perspective view of an alternative backpack support that allows a common seat harness to attach to and support a backpack, without the use of a hip belt.
Figure 12B:
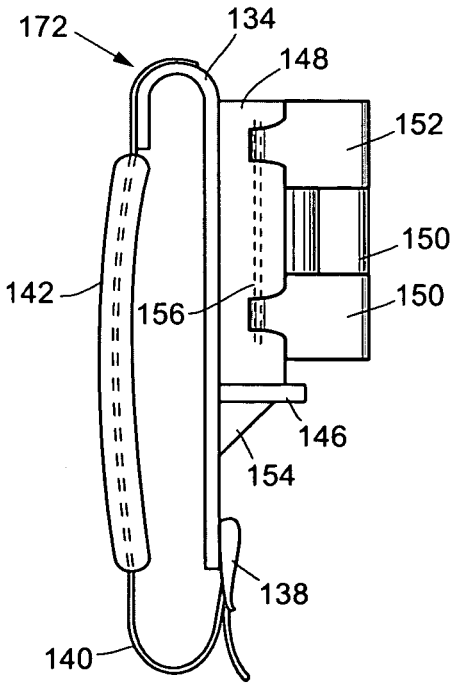
FIG. 12*b* is an orthogonal side view of an alternative backpack support that allows a common seat harness to attach to and support a backpack, without the use of a hip belt.
Figure 12C:
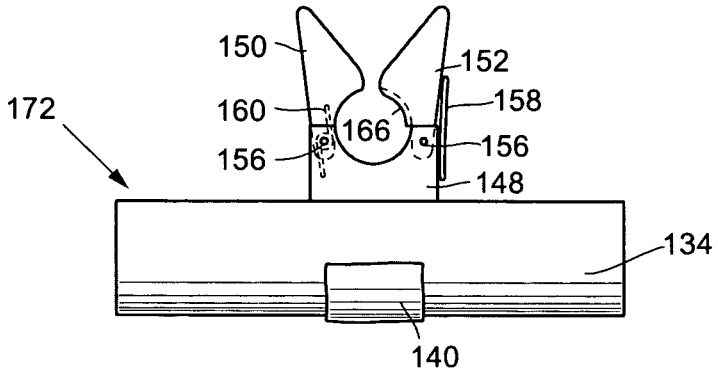
FIG. 12*c* is an orthogonal top view of an alternative backpack support that allows a common seat harness to attach to and support a backpack, without the use of a hip belt.
Figure 12D:
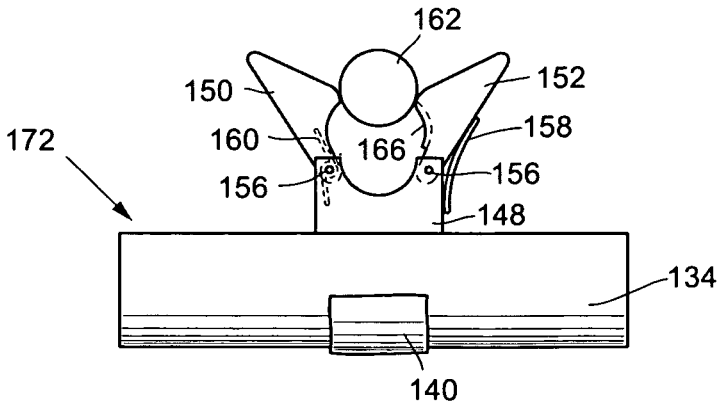
FIG. 12*d* is an orthogonal top view of an alternative backpack support and connective member that can be used to attach a common seat harness to a backpack, without the use of a hip belt.
Figure 12E:
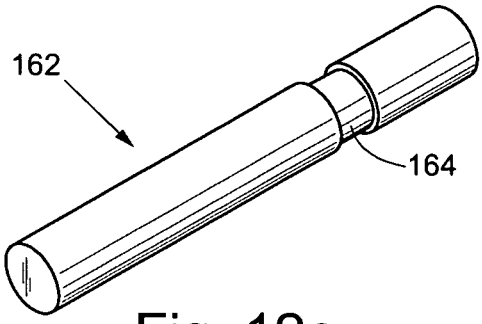
FIG. 12*e* is a perspective view of a connective member that can be used with a backpack support that allows a common seat harness to attach to and support a backpack, without the use of a hip belt.
Figure 12F:
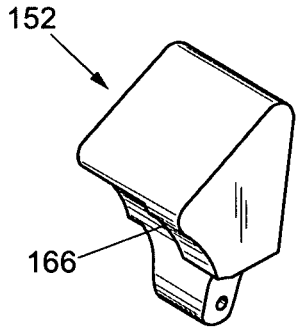
FIG. 12*f* is a perspective view of a top-gate.
Figure 12G:
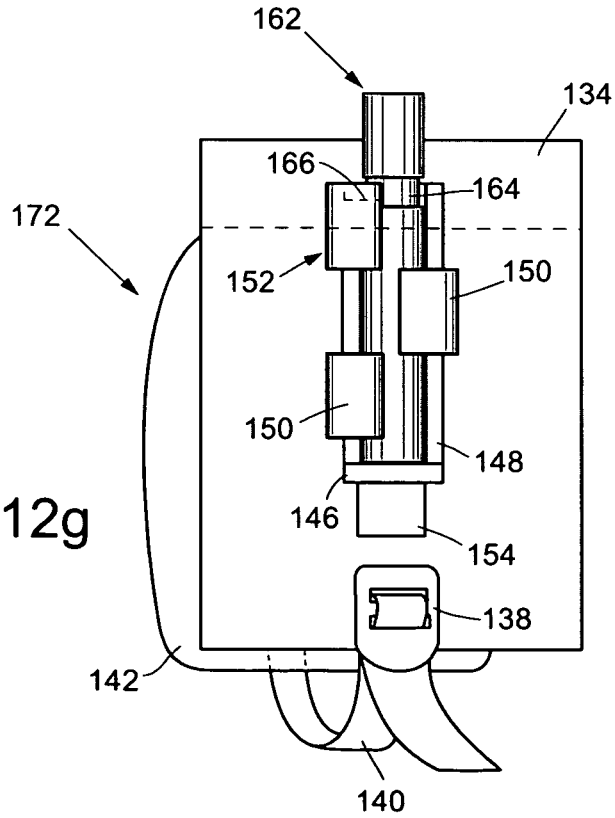
FIG. 12*g* is a perspective view of an alternate backpack support and a connective member.

According to further embodiments, reinforcement members 154 can structurally reinforce the support 146 in order to withstand large loads. In further advantageous embodiments, a singular or plurality (e.g., 1, 2, 3, 4, 5) of pivoting gates 150 and a singular or plurality of top-gates (e.g., 1, 2, 3, 4, 5) 152 can be attached to hinges 156 that are secured to mount 148. The top-gate 152, as depicted in FIG. 12*f*, is preferably constructed with a raised-lip 166 on the interior cylindrical cut. A flat metal spring 158 and/or a torsion spring 160 centered around hinge 156 can be configured to provide force to push gates 150 and top-gate 152 in a vertical position as seen in FIG. 12*c* (closed position). While FIGS. 12*c* and 12*d* depict the use of both a flat metal spring 158 and a torsion spring 160, it is usually preferred that one or the other is used, and not both. Preferred means for attaching the flat metal spring 158 to mount 148 nonexclusively include one or more screws (e.g., 2, 3, 4), but any suitable means can be used. Preferably, the torsion spring 160 is positioned between the gates (gates 150 and the top-gate 152) and the mount 148 and centered around hinge 156 for each gate (gates 150 and top-gate 152).

In further embodiments, it is preferred where one end of the torsion spring 160 pushes gates 150 or top-gate 152 to a closed position, the opposite end of the torsion spring 160 produces a resulting force against the mount 148. In further embodiments, other means, including means utilizing other types of springs, can provide a torque on gates 150 and top-gate 152 to force them into a closed position. In preferred embodiments, closed gates 150 and top-gate 152 are configured to open when a mating connector 162 is pressed against them. (See FIG. 12*d*). Preferably, the gates 150 and top-gate 152 include a top inclined cut in this configuration. Preferably, after a mating connector 162 is pushed against mount 148, the gates 150 and top-gate 152 are forced to a closed position by said springs (torsion spring 160 and/or flat metal spring 158). In order to open the gates 150 and top-gate 152 the user can preferably apply manual force. Other embodiments of this spring loaded attachment device are further contemplated, including varying the number of gates 150, the number of top-gates 152, and the applications of spring force, or utilizing non-spring returned gates (gates 150 and top-gate 152) that maintain a closed position with latches, for example.

In preferred embodiments, a user can put the backpack support 172 on in a similar way as with the backpack support 170 depicted in FIG. 11*b*. More preferably, the user can utilize two backpack supports 172 attached to their seat harness 121 configured to engage with two mating connectors 162 attached to the frame members 82 and 84 in the backpack. Those with skill in the art will readily appreciate that a different number of backpack supports 172, and corresponding mating connectors 162 and frame members 82 and 84 can be used herein. In certain embodiments, only a single backpack support 172 is used; configured to engage with a single mating connector 162 attached to a single frame member on the backpack 20, for example.

While the user can attach the backpack 20 to the backpack support 172 using any appropriate means, in preferred embodiments, the wearer can shrug their shoulders and mechanically push the mating connector 162 against the top angled cuts of gates 150 and top-gate 152 to open the gates. As discussed above, when gates 150 and top-gate 152 open, the mating connector 162 can slide past the gates. Preferably, when the mating connector 162 is pushed against the mount 148, the gates 150 and top-gate 152 close. The wearer can repeat the action for every mating connector 162 and backpack support 172. After each backpack support 172 (e.g., 1, 2, 3, 4) is engaged to the appropriate mating connector 162 (e.g., 1, 2, 3, 4), the wearer can then stop shrugging their shoulders.

For each backpack support 172 and mating connector 162 pair, it is preferred that the mating connector 162 slides down and rests on bottom support 146. According to further embodiments, the raised-lip 166 of the top-gate 152 can be configured to mate with a groove 164 on a mating connector 162 (See FIGS. 12*e* and 12*f*). Just prior to resting on support 146, it is preferred that the groove 164 in mating connector 162 is positioned adjacently to the raised-lip 166 of the top-gate 152. This configuration allows the top-gate 152 to close more tightly on the mating connector 162 than the other gates 150, as the raised-lip 166 rests against the smaller diameter of groove 164, thereby reducing the possibility of mating connecter 162 sliding out of the backpack support 172. Other embodiments include using a raised-lip 166 on any of the other gates 150, or reversing the configuration, such that the raised-lip is located on 1 or more mating connectors 162 and the groove 164 is located on one or more of the gates (gates 150 or top-gate 152). For any of the above described configurations, a plurality of raised-lips and grooves can be used. Further embodiments of a backpack support 172 can include an attached buckle configured to mate with buckle 80 found on backpack 20 such that the mating connector 162 is prevented from detaching from the backpack support 172.

According to preferred embodiments, to release backpack 20 from the backpack supports 172 provided herein, the wearer applies force to the gates 150 and top-gate 152, thereby pivoting them open and thus freeing the mating connector 162 from the mount 148. If desired, the user may shrug their shoulders to further detach the mating connector 162 from the mount 148. Alternatively, these positions and embodiments are interchangeable such that the mating connector can be positioned on the backpack support and the mount can be positioned on the backpack 20. More specifically, the hinged gates described above can be located on a mount positioned on the backpack where a complementary mating connector is position on the backpack support. All embodiments described above may be interchanged and used in this configuration.

The position of all means described herein for connecting the backpack supports to the backpacks, including means for supporting the backpacks, can readily be reversed between the backpack supports and the backpacks. For example, the backpack can include a connective member or a hinged gate assembly. Additionally, all means for connecting to and supporting the backpacks can be interchanged between the backpack supports and hip belts. For example, the backpack supports can include connective rods, latched rods, or pockets configured to engage with an appropriate connection member on the backpack. Likewise, the hip belt/backpack assemblies provided herein can include mating connectors and hinged gate connectors.

The invention may be embodied in other specific forms besides and beyond those described herein. The foregoing embodiments are therefore to be considered in all respects illustrative rather than limiting, and the scope of the invention is defined and limited only by the appended claims and their equivalents, rather than by the foregoing description.

What is claimed is:

1. A backpack assembly configured to be worn by a user and comprising:

(a) a main storage enclosure with one or more shoulder straps that when said straps are worn, the main storage enclosure abuts a user's back and a portion of the main storage enclosure's load is transferred to the user's shoulders, (b) a separate seat harness comprised of an adjustable waist loop in operable connection with pliable material configured to form leg loops such that the separate seat harness has sufficient strength to safely disperse fall-arrest forces to the user's legs and waist when worn by itself, and (c) a hip belt constructed from a bottom panel of pliable material having a top edge, wherein the top edge is hinged to a bottom edge of a top panel of pliable material such that the bottom and top panels are substantially the same size and the bottom and top panels can fold together and unfold away from each other to allow for the removable insertion of the adjustable waist loop of the separate seat harness between said bottom and top panels, wherein the user can detach and attach the main storage enclosure to the hip belt while the user is securely wearing the separate seat harness with the adjustable waist loop of the separate seat harness releasably inserted into the hip belt, and the separate seat harness has sufficient strength to safely disperse fall-arrest forces to the user's legs and waist when operably and releasably coupled to the hip belt and in conjunction with the main storage enclosure, wherein the hip belt comprises means for transferring a substantial portion of the main storage enclosure's load to the user's hips independent of the user wearing the separate seat harness and a portion of the main storage enclosure's load to the adjustable waist loop of the separate seat harness with the adjustable waist loop of the separate seat harness removably inserted into said hip belt.

2. The backpack assembly of claim 1, wherein said means for transferring the main storage enclosure's load consists of one or more support rods and complementary sheaths, and quick release fasteners which allow for releasable attachment between the main storage enclosure and the hip belt.

3. The backpack assembly of claim 1, wherein said means for transferring the main storage enclosure's load comprises a rigid frame member attached to the main storage enclosure and configured to engage with a pocket located on the hip belt.

4. The backpack assembly of claim 1, wherein said means for transferring the main storage enclosure's load comprises a plurality of rigid frame members attached to the main storage enclosure and configured to engage with a plurality of pockets located on the hip belt.

5. The backpack assembly of claim 1, further comprising a layer of material positioned to abut against a user's back when worn, wherein said layer of material comprises an opening configured to allow a user to insert and remove a safety, load-bearing chest harness behind said layer of material and further comprises a plurality of openings configured to allow said user to access and properly secure the inserted chest harness on their body while wearing said backpack assembly wherein the properly secured chest harness has sufficient strength to suspend the combined weight of the loaded backpack assembly and the user.

6. The backpack assembly of claim 5, wherein said layer of material is a pocket constructed from fabric and configured to receive back padding such that said pocket is sewn substantially around its perimeter to said main storage enclosure, and is configured to allow an inserted safety, load-bearing chest harness to suspend the combined weight of a loaded backpack assembly and a user without damaging the backpack assembly.

7. The backpack assembly of claim 1, wherein the top panel of pliable material consists of padding adjacent to the user's hips and the bottom panel of pliable material is capable of transferring a significant portion of the main storage enclosure's load to the user's hips.

8. A backpack assembly comprising:

(a) a main storage enclosure with one or more shoulder straps that when said straps are worn, the main storage enclosure abuts a user's back and a portion of the main storage enclosure's load is transferred to the user's shoulders, (b) a separate seat harness comprised of an adjustable waist loop in operable connection with pliable material configured to form leg loops such that the separate seat harness has sufficient strength to safely disperse fall-arrest forces to the user's legs and waist when worn by itself, and (c) a separate hip belt constructed from a bottom panel of pliable material having a top edge, wherein the top edge is hinged to a bottom edge of a top panel of pliable material such that the bottom and top panels are substantially the same size and can fold together and unfold away from each other to allow for the removable insertion of the adjustable waist loop of the separate seat harness between said bottom and top panels wherein the user can detach and attach the main storage enclosure to the separate hip belt while the user is securely wearing the separate seat harness with the adjustable waist loop of the separate seat harness releasably inserted into the separate hip belt, and the separate seat harness has sufficient strength to safely disperse fall-arrest forces to the user's legs and waist when operably and releasably coupled to the separate hip belt and in conjunction with the main storage enclosure, wherein the separate hip belt comprises means for transferring a substantial portion of the main storage enclosure's load to the user's hips independent of the user wearing the separate seat harness and to the adjustable waist loop of the separate seat harness with the adjustable waist loop of the separate seat harness removably inserted into said separate hip belt.

9. The backpack assembly of claim 8, wherein at least one of said bottom and top panels includes padding.

10. The backpack assembly of claim 8, wherein said means for transferring the main storage enclosure's load comprises a rigid frame member attached to the main storage enclosure and configured to engage with a pocket located on the separate hip belt.

11. The backpack assembly of claim 8, wherein said top and bottom panels are both continuous, such that there are no significant openings in the panels.

12. The backpack assembly of claim 8 wherein the top panel of the hip belt is continuously hinged to the bottom panel of the hip belt along the length of the hinged edge.

13. The backpack assembly of claim 8, wherein said top and bottom panels include means for releasably attaching to each other when said panels are folded together.

14. The backpack assembly of claim 13, wherein at least one of said panels comprises a buckle configured to releasably attach to the other panel when said top and bottom panels are folded together.

15. The backpack assembly of claim 13, wherein said top panel includes a plurality of flaps wherein at least one flap comprises a releasable fastener configured to couple with a releasable fastener on said bottom panel when the top and bottom panels are folded together.

16. The backpack assembly of claim 15, wherein with the adjustable waist loop of the separate seat harness removably inserted into the hip belt said flaps are located on the side of the adjustable waist loop of the separate seat harness opposite the user's body, wherein at least one flap is coupled to the bottom panel.

17. A backpack assembly comprising:

(a) a main storage enclosure with one or more shoulder straps that when said straps are worn, the main storage enclosure abuts a user's back and a portion of the main storage enclosure's load is transferred to the user's shoulders, (b) a separate seat harness comprised of an adjustable waist loop in operable connection with pliable material configured to form leg loops such that the separate seat harness has sufficient strength to safely disperse fall-arrest forces to the user's legs and waist when worn by itself, and (c) a hip belt constructed from an inner panel and an outer panel of material having a top edge and a bottom edge, wherein the top edge of the inner panel is coupled to a top edge of an outer panel of material of substantially the same size as the inner panel such that the length of said outer and inner panels substantially traverse around the circumference of the user's hips, wherein said outer panel and inner panel of the hip belt define a space configured to allow for the removable insertion of the adjustable waist loop of the separate seat harness between said inner and outer panels, wherein the user can releasably detach and attach the main storage enclosure to the hip belt while the user is securely wearing the separate seat harness with the adjustable waist loop of the separate seat harness removably inserted into the hip belt, and the separate seat harness has sufficient strength to safely disperse fall-arrest forces to the user's legs and waist when the adjustable waist loop of the separate seat harness is releasably inserted into the hip belt and in conjunction with the main storage enclosure, and the hip belt comprises means for transferring a substantial portion of the main storage enclosure's load to the user's hips independently or with the adjustable waist loop of the separate seat harness removably inserted into said hip belt.

18. The backpack assembly of claim 17, wherein both panels are continuous, such that there are no significant openings in the panels.

19. The backpack assembly of claim 17, wherein said means for transferring the main storage enclosure's load comprises a rigid frame member attached to the main storage enclosure and configured to engage with a pocket located on the hip belt.

20. The backpack assembly of claim 17, wherein said means for transferring the main storage enclosure's load comprises a plurality of rigid frame members attached to the main storage enclosure and configured to engage with a plurality of pockets located on the hip belt.

21. The backpack assembly of claim 17, wherein the inner panel consists of pliable padding and the outer panel consist of a rigid material and said inner panel and said outer panel can fold and unfold away from each other.

22. The backpack assembly of claim 17, wherein the inner panel and the outer panel are constructed of pliable material and the bottom edge of the inner panel of pliable material is coupled to the bottom edge of the outer panel of pliable material such that the defined space is a channel configured to allow for the removable insertion of the adjustable waist loop of the separate seat harness.

* * * * *